US009492998B2

(12) United States Patent
Nakajima et al.

(10) Patent No.: US 9,492,998 B2
(45) Date of Patent: Nov. 15, 2016

(54) IMAGE PROCESSING APPARATUS AND IMAGE PROCESSING METHOD

(71) Applicant: CANON KABUSHIKI KAISHA, Tokyo (JP)

(72) Inventors: Yoshinori Nakajima, Yokohama (JP); Yoshinori Nakagawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/092,426

(22) Filed: Apr. 6, 2016

(65) Prior Publication Data

US 2016/0303850 A1 Oct. 20, 2016

(30) Foreign Application Priority Data

Apr. 14, 2015 (JP) ..... 2015-082596

(51) Int. Cl.
*B41J 2/045* (2006.01)

(52) U.S. Cl.
CPC ..... *B41J 2/04573* (2013.01); *B41J 2/04581* (2013.01); *B41J 2/04585* (2013.01)

(58) Field of Classification Search
CPC .... B41J 2/2142; B41J 2/04501; B41J 2/125; B41J 2/04581; B41J 2/04585; B41J 2/04573; B41J 2/165; B41J 2/16579; B41J 2202/20; B41J 2/2139; B41J 2/2146
See application file for complete search history.

(56) References Cited

U.S. PATENT DOCUMENTS

2007/0046706 A1* 3/2007 Kayahara ..... B41J 2/2128 347/14

FOREIGN PATENT DOCUMENTS

JP 2003-175592 A 6/2003
JP 2007-176158 A 7/2007

* cited by examiner

*Primary Examiner* — Thinh Nguyen
(74) *Attorney, Agent, or Firm* — Canon USA, Inc. IP Division

(57) ABSTRACT

In a case in which a difference between a total value of numbers of ink discharge times for a target divided region and a representative value of the numbers of ink discharge times for a plurality of divided regions adjacent to the target divided region is large, the total value of the numbers of ink discharge times for the target divided region is reduced.

19 Claims, 21 Drawing Sheets

| | | | |
|---|---|---|---|
| 700 | 701 | 702 | 703 |
| 704 | 705 | 706 | 707 |
| 708 | 709 | 710 | 711 |
| 712 | 713 | 714 | 715 |

| | | | |
|---|---|---|---|
| 11 | 10 | 01 | 00 |
| 11 | 10 | 01 | 00 |
| 11 | 10 | 01 | 00 |
| 11 | 10 | 01 | 00 |

| | | | | |
|---|---|---|---|---|
| 11 | 10 | 01 | 00 | 505 |
| 00 | 11 | 10 | 01 | |
| 01 | 00 | 11 | 10 | |
| 10 | 01 | 00 | 11 | |

| | | | | |
|---|---|---|---|---|
| 10 | 01 | 00 | 11 | 506 |
| 11 | 10 | 01 | 00 | |
| 00 | 11 | 10 | 01 | |
| 01 | 00 | 11 | 10 | |

| | | | | |
|---|---|---|---|---|
| 01 | 00 | 11 | 10 | 507 |
| 10 | 01 | 00 | 11 | |
| 11 | 10 | 01 | 00 | |
| 00 | 11 | 10 | 01 | |

| | | | | |
|---|---|---|---|---|
| 00 | 11 | 10 | 01 | 508 |
| 01 | 00 | 11 | 10 | |
| 10 | 01 | 00 | 11 | |
| 11 | 10 | 01 | 00 | |

| | | | |
|---|---|---|---|
| 1 | 1 | 0 | 0 |
| 0 | 1 | 0 | 0 |
| 1 | 0 | 1 | 0 |
| 1 | 0 | 0 | 0 |

| | | | |
|---|---|---|---|
| 1 | 0 | 0 | 0 |
| 1 | 1 | 0 | 0 |
| 0 | 1 | 0 | 0 |
| 1 | 0 | 1 | 0 |

| | | | |
|---|---|---|---|
| 1 | 0 | 1 | 0 |
| 1 | 0 | 0 | 0 |
| 1 | 1 | 0 | 0 |
| 0 | 1 | 0 | 0 |

| | | | |
|---|---|---|---|
| 0 | 1 | 0 | 0 |
| 1 | 0 | 1 | 0 |
| 1 | 0 | 0 | 0 |
| 1 | 1 | 0 | 0 |

| | | | |
|---|---|---|---|
| 3 | 2 | 1 | 0 |
| 3 | 2 | 1 | 0 |
| 3 | 2 | 1 | 0 |
| 3 | 2 | 1 | 0 |

FIG. 7

| ○ : PRINT<br>× : NOT PRINT | | CODE VALUE IN MASK PATTERN | | | |
|---|---|---|---|---|---|
| | | 00 | 01 | 10 | 11 |
| PIXEL VALUE IN IMAGE DATA | 00 | × | × | × | × |
| | 01 | × | × | × | ○ |
| | 10 | × | × | ○ | ○ |
| | 11 | × | ○ | ○ | ○ |

| | | | | | | | |
|---|---|---|---|---|---|---|---|
| 01 | 01 | 01 | 10 | 10 | 11 | 11 | 11 |
| 00 | 01 | 01 | 11 | 11 | 11 | 11 | 11 |
| 00 | 01 | 10 | 11 | 11 | 11 | 11 | 11 |
| 00 | 00 | 01 | 11 | 11 | 01 | 11 | 10 |
| 00 | 00 | 00 | 00 | 11 | 10 | 10 | 01 |
| 00 | 00 | 00 | 00 | 10 | 01 | 01 | 01 |
| 00 | 00 | 00 | 00 | 00 | 00 | 01 | 01 |
| 00 | 00 | 00 | 00 | 00 | 00 | 00 | 00 |

606 607

| | | | |
|---|---|---|---|
| 3 | 7 | 11 | 12 |
| 1 | 9 | 10 | 11 |
| 0 | 0 | 8 | 5 |
| 0 | 0 | 0 | 2 |

611

| | | | | | | | |
|---|---|---|---|---|---|---|---|
| 01 | 01 | 01 | 10 | 10 | 11 | 11 | 11 |
| 00 | 01 | 01 | 11 | 11 | 11 | 11 | 11 |
| 00 | 01 | 01 | 10 | 10 | 10 | 11 | 11 |
| 00 | 00 | 00 | 10 | 10 | 00 | 11 | 10 |
| 00 | 00 | 00 | 00 | 10 | 01 | 10 | 01 |
| 00 | 00 | 00 | 00 | 01 | 00 | 01 | 01 |
| 00 | 00 | 00 | 00 | 00 | 00 | 01 | 01 |
| 00 | 00 | 00 | 00 | 00 | 00 | 00 | 00 |

606 607

| | | | |
|---|---|---|---|
| 3 | 7 | 11 | 12 |
| 1 | 5 | 6 | 11 |
| 0 | 0 | 4 | 5 |
| 0 | 0 | 0 | 2 |

611

FIG. 15A
| | | | | | | | |
|---|---|---|---|---|---|---|---|
| 01 | 01 | 01 | 10 | 10 | 11 | 11 | 11 |
| 00 | 01 | 01 | 11 | 11 | 11 | 11 | 11 |
| 00 | 01 | 10 | 11 | 11 | 11 | 11 | 11 |
| 00 | 00 | 01 | 11 | 11 | 01 | 11 | 10 |
| 00 | 00 | 00 | 00 | 11 | 10 | 10 | 01 |
| 00 | 00 | 00 | 00 | 10 | 01 | 01 | 01 |
| 00 | 00 | 00 | 00 | 00 | 00 | 01 | 01 |
| 00 | 00 | 00 | 00 | 00 | 00 | 00 | 00 |
FIG. 15B
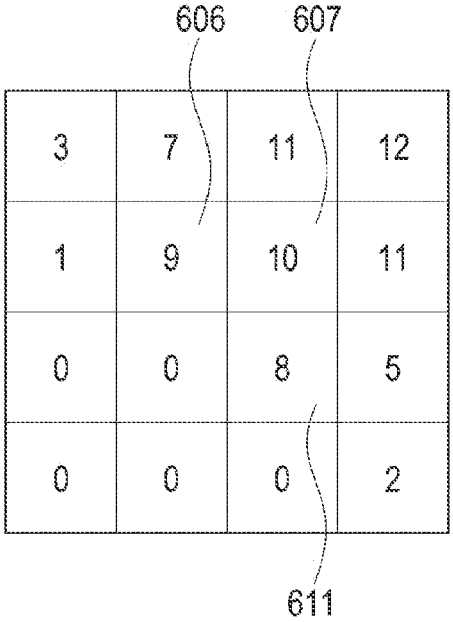
FIG. 15C
| | | | | | | | |
|---|---|---|---|---|---|---|---|
| 01 | 01 | 01 | 10 | 10 | 11 | 11 | 11 |
| 00 | 01 | 01 | 11 | 11 | 11 | 11 | 11 |
| 00 | 01 | 01 | 10 | 10 | 10 | 11 | 11 |
| 00 | 00 | 01 | 10 | 10 | 01 | 11 | 10 |
| 00 | 00 | 00 | 00 | 10 | 01 | 10 | 01 |
| 00 | 00 | 00 | 00 | 01 | 01 | 01 | 01 |
| 00 | 00 | 00 | 00 | 00 | 00 | 01 | 01 |
| 00 | 00 | 00 | 00 | 00 | 00 | 00 | 00 |
FIG. 15D
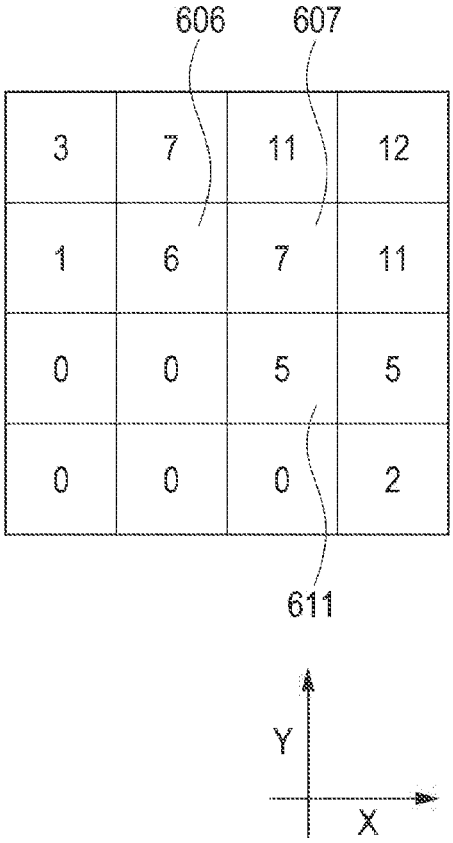

| | | | | | | | |
|---|---|---|---|---|---|---|---|
| 01 | 01 | 01 | 10 | 10 | 11 | 11 | 11 |
| 00 | 01 | 01 | 11 | 11 | 11 | 11 | 11 |
| 00 | 01 | 10 | 11 | 11 | 11 | 11 | 11 |
| 00 | 00 | 01 | 11 | 11 | 01 | 11 | 10 |
| 00 | 00 | 00 | 00 | 11 | 10 | 10 | 01 |
| 00 | 00 | 00 | 00 | 10 | 01 | 01 | 01 |
| 00 | 00 | 00 | 00 | 00 | 00 | 01 | 01 |
| 00 | 00 | 00 | 00 | 00 | 00 | 00 | 00 |

606 607

| | | | |
|---|---|---|---|
| 3 | 7 | 11 | 12 |
| 1 | 9 | 10 | 11 |
| 0 | 0 | 8 | 5 |
| 0 | 0 | 0 | 2 |

611

| | | | | | | | |
|---|---|---|---|---|---|---|---|
| 01 | 01 | 01 | 10 | 10 | 11 | 11 | 11 |
| 00 | 01 | 01 | 11 | 11 | 11 | 11 | 11 |
| 00 | 01 | 01 | 10 | 11 | 11 | 11 | 11 |
| 00 | 00 | 00 | 10 | 11 | 01 | 11 | 10 |
| 00 | 00 | 00 | 00 | 10 | 01 | 10 | 01 |
| 00 | 00 | 00 | 00 | 01 | 00 | 01 | 01 |
| 00 | 00 | 00 | 00 | 00 | 00 | 01 | 01 |
| 00 | 00 | 00 | 00 | 00 | 00 | 00 | 00 |

606 607

| | | | |
|---|---|---|---|
| 3 | 7 | 11 | 12 |
| 1 | 5 | 10 | 11 |
| 0 | 0 | 4 | 5 |
| 0 | 0 | 0 | 2 |

611

FIG. 19A
| | | | | | | | |
|---|---|---|---|---|---|---|---|
| 01 | 01 | 01 | 10 | 10 | 11 | 11 | 11 |
| 00 | 01 | 01 | 11 | 11 | 11 | 11 | 11 |
| 00 | 01 | 10 | 11 | 11 | 11 | 11 | 11 |
| 00 | 00 | 01 | 11 | 11 | 01 | 11 | 10 |
| 00 | 00 | 00 | 00 | 11 | 10 | 10 | 01 |
| 00 | 00 | 00 | 00 | 10 | 01 | 01 | 01 |
| 00 | 00 | 00 | 00 | 00 | 00 | 01 | 01 |
| 00 | 00 | 00 | 00 | 00 | 00 | 00 | 00 |
FIG. 19B
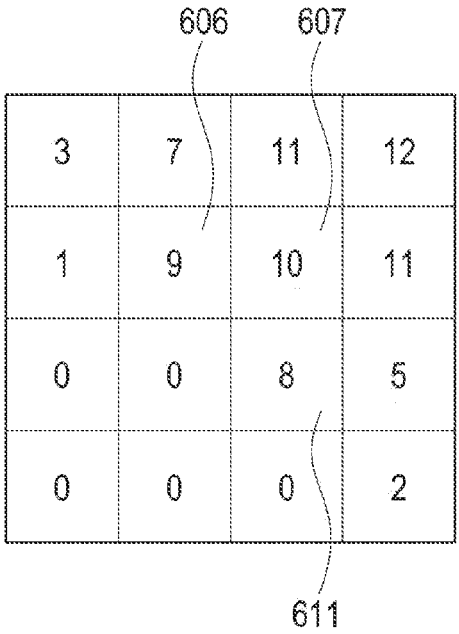
FIG. 19C
| | | | | | | | |
|---|---|---|---|---|---|---|---|
| 01 | 01 | 01 | 10 | 10 | 11 | 11 | 11 |
| 00 | 01 | 01 | 11 | 11 | 11 | 11 | 11 |
| 00 | 01 | 01 | 11 | 11 | 11 | 11 | 11 |
| 00 | 00 | 00 | 10 | 10 | 01 | 11 | 10 |
| 00 | 00 | 00 | 00 | 10 | 10 | 10 | 01 |
| 00 | 00 | 00 | 00 | 01 | 00 | 01 | 01 |
| 00 | 00 | 00 | 00 | 00 | 00 | 01 | 01 |
| 00 | 00 | 00 | 00 | 00 | 00 | 00 | 00 |
FIG. 19D
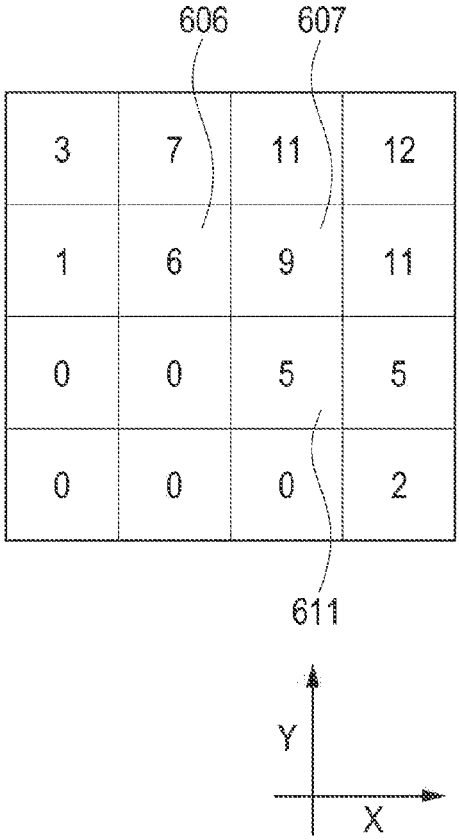

FIG. 21

| ○ : PRINT<br>× : NOT PRINT | | CODE VALUE IN MASK PATTERN | | | |
|---|---|---|---|---|---|
| | | 00 | 01 | 10 | 11 |
| PIXEL VALUE IN IMAGE DATA | 00 | × | × | × | × |
| | 01 | × | ○ | × | × |
| | 10 | × | ○ | × | ○ |
| | 11 | × | ○ | ○ | ○ |

IMAGE PROCESSING APPARATUS AND IMAGE PROCESSING METHOD

BACKGROUND OF THE INVENTION

1. Field of the Invention

The present invention relates to an image processing apparatus and an image processing method.

2. Description of the Related Art

There has been known an image recording device that records an image by repetitively performing scanning and recording operations and sub scanning. In the scanning and recording operations, the image recording device discharges ink while relatively moving a recording head with respect to a unit region of a recording medium. The recording head includes a discharge port array in which a plurality of discharge ports for discharging ink is arrayed. In the sub scanning, the recording medium is conveyed. In such an image recording device, there has been known a so-called multipass printing method of forming an image by performing the scanning and recording operations with respect to the unit region a plurality of times. In a conventional multipass printing method, using image data including one-bit information that defines discharge or non-discharge of ink for each pixel, and a plurality of mask patterns each including one-bit information that defines permission or non-permission of ink discharge for each pixel, and respectively corresponding to a plurality of times of scanning, recording data to be used for performing recording through the plurality of times of scanning is generated by dividing the image data into the plurality of times of scanning.

Furthermore, in recent years, there has been also known the technique of generating recording data using image data including multiple-bit information that can define a plurality of patterns of the numbers of ink discharge times for each pixel, and a plurality of mask patterns each including multiple-bit information that defines the number of ink discharge permitted times for each pixel, and respectively corresponding to a plurality of times of scanning. By generating the recording data in the above-described manner, ink can be discharged onto one pixel region a plurality of times. For example, Japanese Patent Application Laid-Open No. 2003-175592 discloses generating recording data using image data and mask patterns each including two-bit information.

On the other hand, there has been conventionally known image quality deterioration that occurs in the following manner. Specifically, ink of a predetermined color bleeds at an edge region where a region onto which recording has been performed using the ink of the predetermined color (an object) contacts a region onto which recording has been performed using ink of another color, a blank region onto which no recording has been performed, or the like. Such bleeding deteriorates image quality. To solve such image quality deterioration, Japanese Patent Application Laid-Open No. 2007-176158 discloses detecting an edge region from a region where an image is to be recorded, and thinning out image data for ink of a predetermined color that correspond to the edge region, in the case of using image data and mask patterns each including one-bit information. According to Japanese Patent Application Laid-Open No. 2007-176158, the amount of the ink of the predetermined color that is discharged onto the edge region of the image can be reduced as compared with the amount of ink discharged onto a non-edge region other than the edge region of the image. Thus, image quality deterioration that is caused by ink bleeding can be suppressed.

Nevertheless, the processing disclosed in Japanese Patent Application Laid-Open No. 2007-176158 is processing performed on image data with which ink can be discharged onto one pixel region only once. Thus, such a technique cannot be applied to correction processing of image data corresponding to an edge region that is performed in the case of using image data with which ink can be discharged onto one pixel region a plurality of times.

SUMMARY OF THE INVENTION

Thus, an image processing apparatus according to an aspect of the present invention is an image processing apparatus for generating recording data to be used in each of a plurality of times of relative scanning of a recording head including a discharge port array in which discharge ports for discharging ink are arrayed in a predetermined direction, with respect to a unit region on a recording medium, in a crossing direction intersecting with the predetermined direction, the recording data defining ink discharge or non-discharge for each of a plurality of pixel regions corresponding to a plurality of pixels in the unit region, and the image processing apparatus includes a first acquisition unit configured to acquire image data in which information about a number of ink discharge times from 0 to N ($N \geq 2$) for each of the plurality of pixel regions is defined for each pixel, a second acquisition unit configured to acquire, for each of a plurality of divided regions being obtained by dividing the unit region in the predetermined direction and the crossing direction and each including a plurality of pixel regions, information about a total value of respective numbers of ink discharge times for the plurality of pixel regions in each of the divided regions based on the image data acquired by the first acquisition unit, a third acquisition unit configured to acquire, based on pieces of information about the respective total values for a plurality of divided regions adjacent to a target divided region, among pieces of information about the respective total values for the plurality of divided regions that have been acquired by the second acquisition unit, information about a representative value of numbers of ink discharge times for the plurality of adjacent divided regions, a first generation unit configured to generate, based on the information acquired by the second acquisition unit and the information acquired by the third acquisition unit, correction data in which information indicating the number of ink discharge times from 0 to N for each of the plurality of pixel regions is defined for each pixel, and a second generation unit configured to generate, based on the correction data generated by the first generation unit, the recording data to be used in each of the plurality of times of scanning, wherein, (i) in a case in which a difference between the total value for the target divided region that is indicated by the information acquired by the second acquisition unit, and the representative value for the plurality of adjacent divided regions that is indicated by the information acquired by the third acquisition unit is larger than a first threshold value, the first generation unit generates the correction data so that a total value of the numbers of ink discharge times for the target divided region that is indicated by the correction data becomes smaller than a total value of the numbers of ink discharge times for the target divided region that is indicated by the image data, and (ii) in a case in which the difference is smaller than the first threshold value, the first generation unit generates the correction data so that a total value of the numbers of ink discharge times for the target divided region that is indicated by the correction data becomes equal to a total value of the numbers of ink discharge times for the target divided region that is indicated by the image data.

Further features of the present invention will become apparent from the following description of exemplary embodiments (with reference to the attached drawings).

BRIEF DESCRIPTION OF THE DRAWINGS

FIGS. 6A, 6B, 6C-1 to 6C-4, 6D-1 to 6D-4, and 6E are diagrams illustrating a processing procedure of mask patterns and image data according to an exemplary embodiment.

FIG. 7 is a diagram illustrating an example of a decode table according to an exemplary embodiment.

FIGS. 15A, 15B, 15C, and 15D are diagrams for illustrating a procedure of edge region correction processing according to an exemplary embodiment.

FIGS. 19A, 19B, 19C, and 19D are diagrams for illustrating a procedure of edge region correction processing according to an exemplary embodiment.

FIG. 21 is a diagram illustrating an example of a decode table according to an exemplary embodiment.

DESCRIPTION OF THE EMBODIMENTS

A first exemplary embodiment of the present invention will be described in detail below with reference to the drawings.

First Exemplary Embodiment

Figure 1:
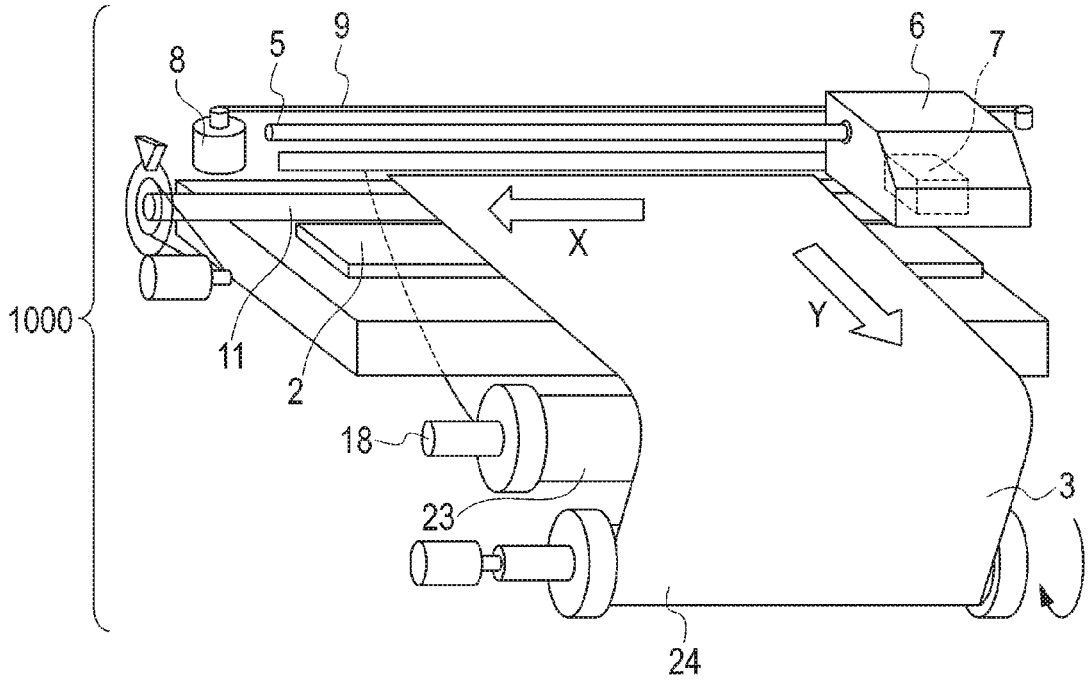
FIG. 1 is a perspective view of an image recording device to be applied in an exemplary embodiment.
Figure 2:
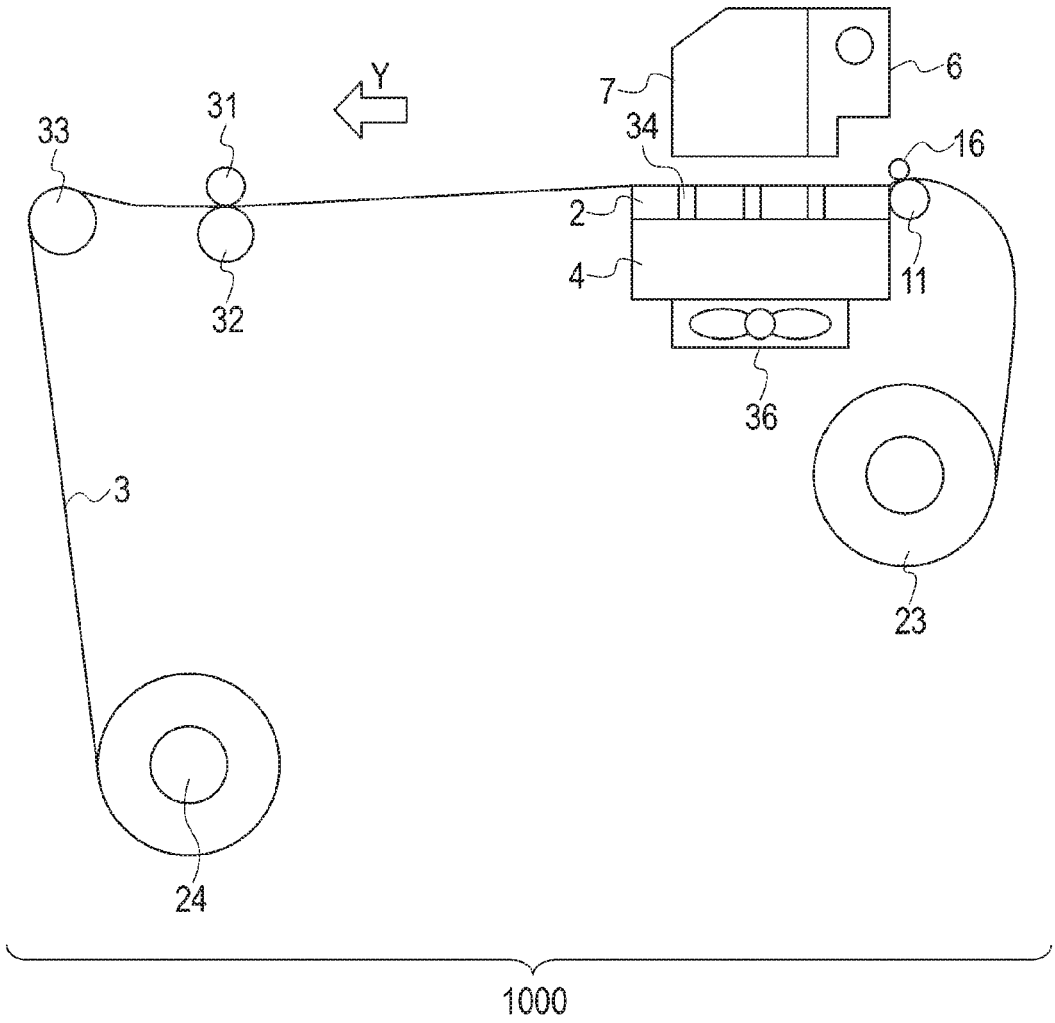
FIG. 2 is a cross-sectional view of an internal configuration of the image recording device to be applied in an exemplary embodiment.

FIG. 1 is a perspective view partially illustrating an internal configuration of an image recording device 1000 according to the first exemplary embodiment of the present invention. In addition, FIG. 2 is a cross-sectional view partially illustrating an internal configuration of the image recording device 1000 according to the first exemplary embodiment of the present invention.

A platen 2 is provided inside the image recording device 1000. A number of suction holes 34 are formed in the platen 2 for sticking a recording medium 3 so as not to float up. The suction holes 34 are connected to a duct. Furthermore, a suction fan 36 is provided below the duct. By operating the suction fan 36, the recording medium 3 is stuck to the platen 2.

A carriage 6 is supported on a main rail 5 installed with extending in a sheet width direction, and is configured to be reciprocally movable in an X direction (crossing direction). The carriage 6 is equipped with an inkjet type recording head 7 to be described later. In addition, the recording head 7 can employ various recording methods such as a thermal jet method using a heating element and a piezoelectric method using a piezoelectric element. A carriage motor 8 is a driving source for moving the carriage 6 in the X direction, and the generated rotational driving force is transferred via a belt 9 to the carriage 6.

The recording medium 3 is fed by being wound off from a rolled medium 23. The recording medium 3 is conveyed on the platen 2 in a Y direction (conveyance direction) intersecting with the X direction. The leading edge of the recording medium 3 is pinched by a pinching roller 16 and a conveyance roller 11. When the conveyance roller 11 is driven, the recording medium 3 is conveyed. In addition, the recording medium 3 is pinched by a roller 31 and a discharge roller 32 on the downstream side of the platen 2 in the Y direction. Furthermore, the recording medium 3 passes through a turning roller 33 to be wound up by a winding roller 24.

Figure 3:
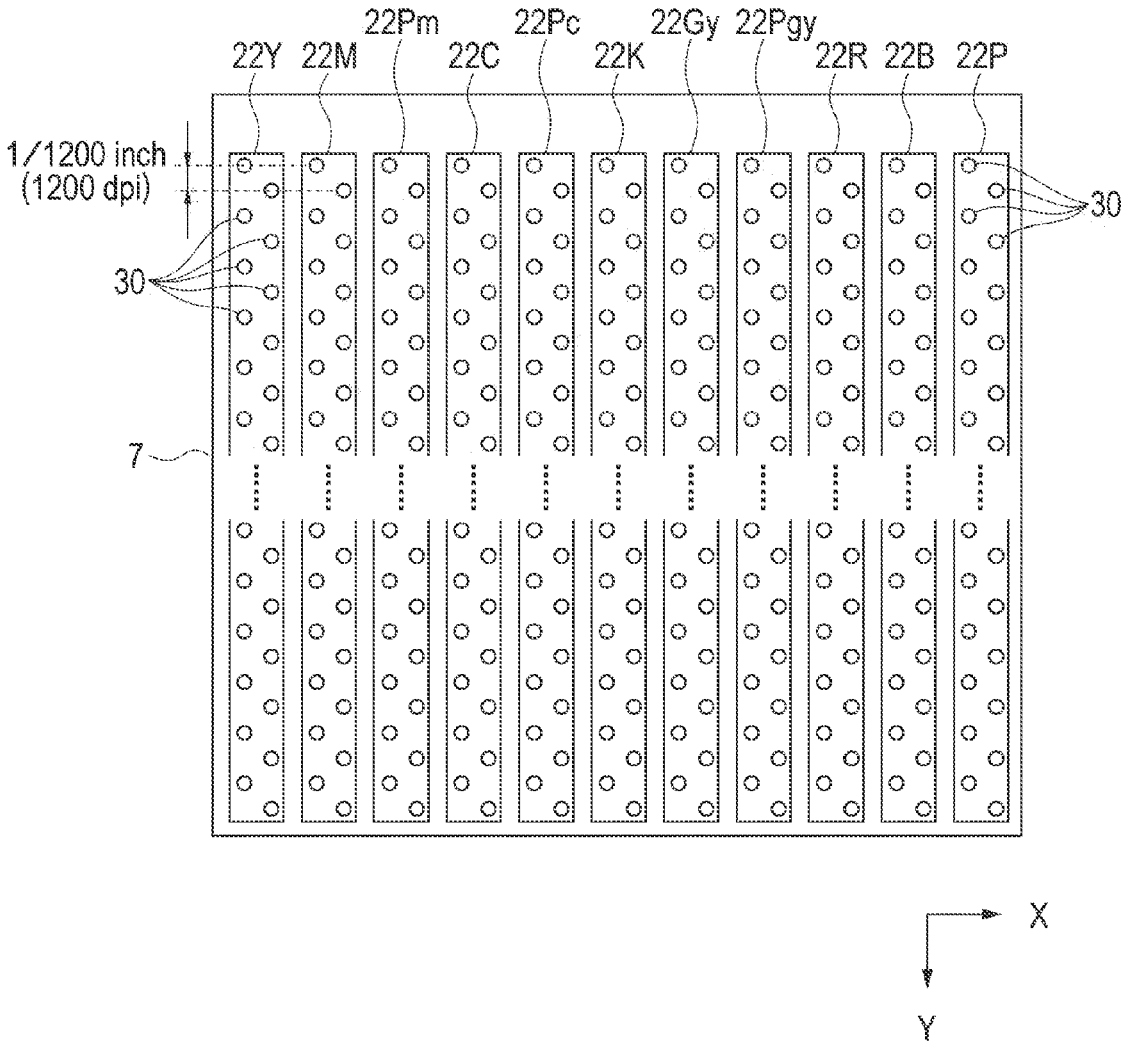
FIG. 3 is a schematic view of a recording head to be applied in an exemplary embodiment.

FIG. 3 illustrates a recording head 7 to be used in the present exemplary embodiment.

The recording head 7 includes eleven discharge port arrays 22Y, 22M, 22Pm, 22C, 22Pc, 22Bk, 22Gy, 22Pgy, 22R, 22B, and 22P (hereinafter, one discharge port array of these discharge port arrays will be also referred to as a discharge port array 22) that can discharge respective inks of yellow (Y), magenta (M), photo magenta (Pm), cyan (C), photo cyan (Pc), black (Bk), gray (Gy), photo gray (Pgy), red (R), blue (B), and processing liquid (P) having a purpose other than coloring, such as the protection of a recording surface and the improvement of gloss uniformity, and are arranged in the X direction in this order. These discharge port arrays 22 each include 1280 discharge ports (hereinafter, also referred to as nozzles) 30 for discharging the respective inks that are arrayed in the Y direction (predetermined direction) with a density of 1200 dpi. In addition, discharge ports 30 located at positions adjacent to each other in the Y direction are arranged at positions shifted from each other in the X direction. In the present exemplary embodiment, the discharge amount of ink discharged from one discharge port 30 at one time is approximately 4.5 ng.

These discharge port arrays 22 are connected to ink tanks (not illustrated) for storing the respective inks, and the inks are supplied therefrom. In addition, the recording head 7 and the ink tanks that are used in the present exemplary embodiment may be integrally formed, or may be each configured to be separable.

Figure 4:
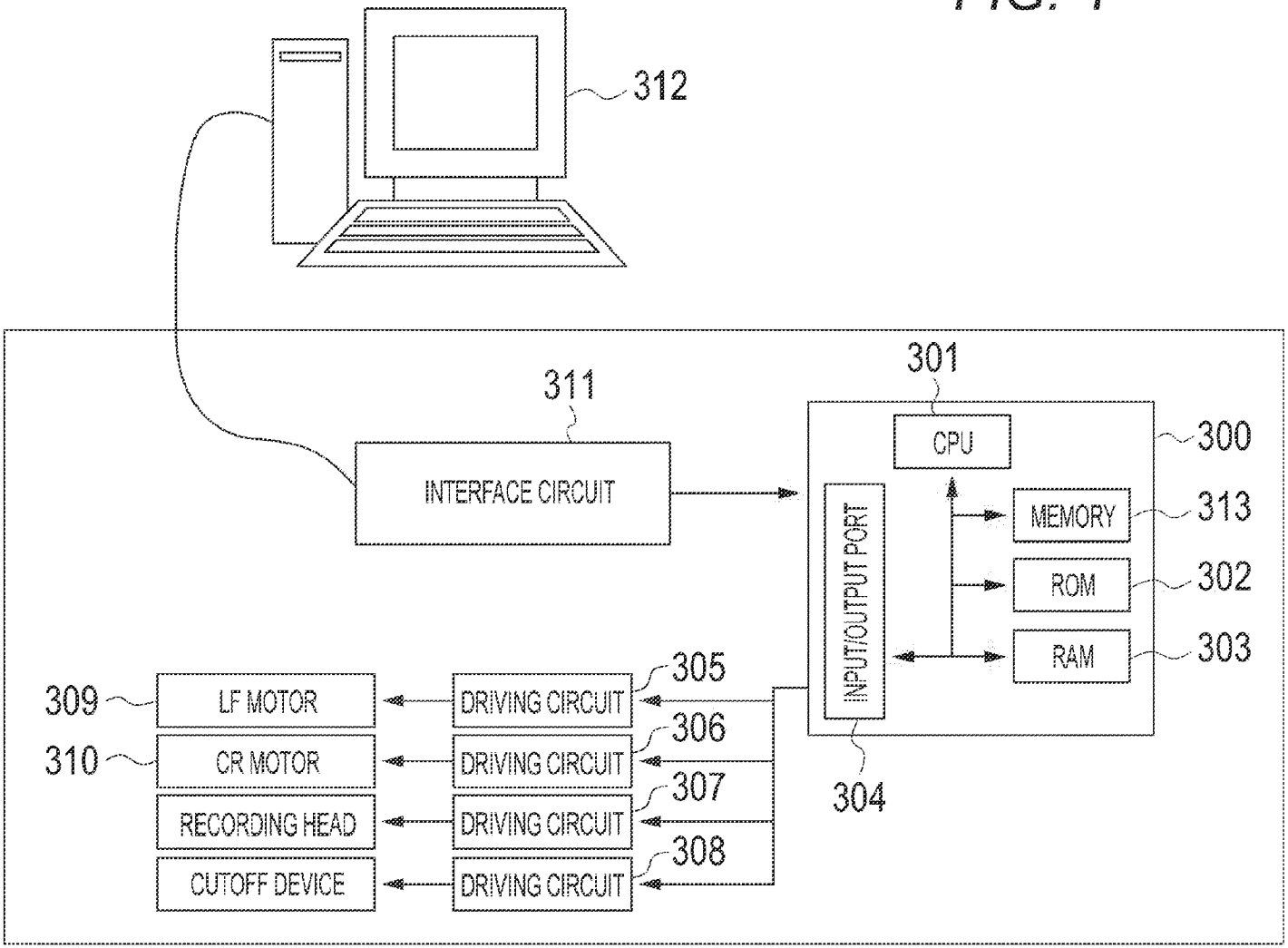
FIG. 4 is a schematic view illustrating a recording control system according to an exemplary embodiment.

FIG. 4 is a block diagram illustrating a schematic configuration of a control system according to the present exemplary embodiment. A main control unit 300 includes a central processing unit (CPU) 301, a read-only memory (ROM) 302, a random access memory (RAM) 303, an input/output port 304, and the like. The CPU 301 executes processing operations such as calculation, selection, determination, and control. The ROM 302 stores, for example, a control program to be executed by the CPU 301. The RAM 303 is used as a buffer of recording data, or the like. A memory 313 stores image data and mask patterns that are to be described later, faulty nozzle data, and the like. In addition, respective driving circuits 305, 306, 307, and 308 such as actuators for a conveyance motor (an LF motor) 309, a carriage motor (CR motor) 310, the recording head 7, and a cutoff device are connected to the input/output port 304. Furthermore, the main control unit 300 is connected via an interface circuit 311 to a PC 312, which is a host computer.

In the present exemplary embodiment, an image is formed according to a so-called multipass printing method of performing recording by scanning a recording head a plurality of times with respect to a unit region on a recording medium. The multipass printing method will be described in detail below.

Figure 5:
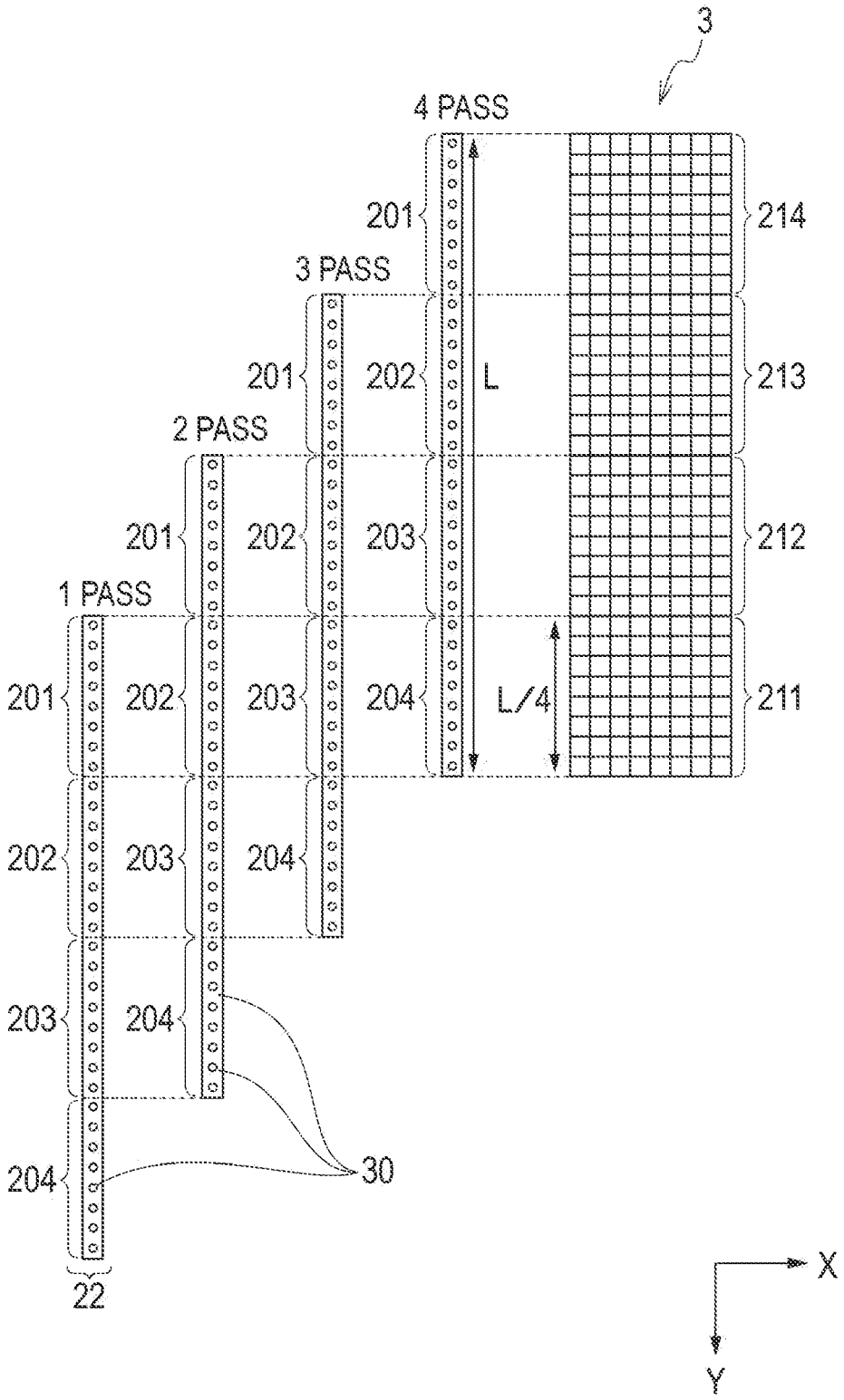
FIG. 5 is a diagram for illustrating a general multipass printing method.

FIG. 5 is a diagram for illustrating a general multipass printing method using an example case of performing recording onto a unit region through four scanning operations.

The discharge ports 30 for discharging ink that are provided in each of the discharge port arrays 22 are divided into four discharge port groups 201, 202, 203, and 204 along the Y direction. In this example, the length in the Y direction of each of the discharge port groups 201, 202, 203, and 204 is denoted by L/4 when the length in the Y direction of the discharge port array 22 is denoted by L.

In the first scanning and recording operations (1 pass), ink is discharged from the discharge port group 201 onto a unit region 211 on the recording medium 3.

Next, the recording medium 3 is relatively conveyed with respect to the recording head 7 from the upstream side to the downstream side in the Y direction by a distance corresponding to L/4. In addition, for the sake of simplification, FIG. 5 illustrates a case in which the recording head 7 is conveyed relative to the recording medium 3 from the downstream side to the upstream side in the Y direction. Nevertheless, the relative positional relationship between the recording medium 3 and the recording head 7 that is obtainable after the conveyance is the same as that in a case in which the recording medium 3 is conveyed toward the Y direction downstream side.

After the first scanning and recording operations, the second scanning and recording operations are performed. In the second scanning and recording operations (2 pass), ink is discharged from a discharge port group 202 onto the unit region 211 on the recording medium, and from the discharge port group 201 onto a unit region 212.

Thereafter, the scanning and recording operations of the recording head 7 and the relative conveyance of the recording medium 3 are alternately repeated. As a result, after the fourth scanning and recording operations (4 pass) are performed, ink is discharged onto the unit region 211 of the recording medium 3 once from each of the discharge port groups 201 to 204.

In addition, in this example, the case of performing recording through four scanning operations has been described. The recording can be performed by a similar procedure also in the case of performing recording by performing scanning operations a different number of times.

In the present exemplary embodiment, in the above-described multipass printing method, one-bit recording data to be used for recording in each scanning operation is generated from image data using image data including a-bit information (a≥2), mask patterns each including b-bit information (b≥2), and a decode table that defines discharge or non-discharge of ink according to the combination of values indicated by respective pieces of multiple-bit information in the image data and the mask pattern. In addition, in the following description, a case in which both of the image data and the mask patterns include two-bit information will be described.

Figures 1, 2, 3, 4, 6A, 6B, 6C, 6D, 6E:
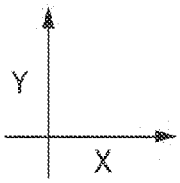

FIGS. 6A, 6B, 6C-1 to 6C-4, 6D-1 to 6D-4, and 6E are diagrams for illustrating a procedure for generating recording data using image data and mask patterns each including multiple-bit information. In addition, FIG. 7 is a diagram illustrating a decode table used in the generation of the recording data as illustrated in FIGS. 6D-1 to 6D-4.

FIG. 6A is a diagram schematically illustrating 16 pixels 700 to 715 in a certain unit region. In addition, in this example, for the sake of simplification, the description will be given using the unit region including pixel regions corresponding to 16 pixels. Nevertheless, the number of pixel regions constituting a unit region can be appropriately set to a different value.

FIG. 6B is a diagram illustrating an example of image data corresponding to the unit region. In this example, the image data including a-bit information can reproduce up to (2^a) patterns of the numbers of ink discharge times. In the present exemplary embodiment, the image data includes two-bit information as described above. Thus, up to 4 (=2^2) patterns, which is square of 2, of the numbers of ink discharge times can be reproduced.

In addition, in the present exemplary embodiment, the maximum value of the number of ink discharge times reproduced by image data including a-bit information is set to (2^a)−1. Since a=2 is set in the present exemplary embodiment, the maximum value among the reproduced numbers of ink discharge times is 3 (=(2^2)−1), which is a value obtained by subtracting 1 from the square of 2.

Specifically, when a value indicated by two-bit information included in image data corresponding to a certain pixel (hereinafter, also referred to as a pixel value) is "00", no ink is discharged onto the pixel. In addition, when a pixel value is "01", ink is discharged onto a corresponding pixel once. In addition, when a pixel value is "10", ink is discharged onto a corresponding pixel twice. In addition, when a pixel value is "11", ink is discharged onto a corresponding pixel three times. In this manner, in image data according to the present exemplary embodiment, any of the numbers of discharge times from 0 to 3 is defined for each pixel.

As for the image data illustrated in FIG. 6B, for example, since pixel values in the pixels 703, 707, 711, and 715 are "00", no ink is discharged onto pixel regions corresponding to the pixels 703, 707, 711, and 715. In addition, for example, since pixel values in the pixels 700, 704, 708, and 712 are "11", ink is discharged onto pixel regions corresponding to the pixels 700, 704, 708, and 712 three times.

FIGS. 6C-1 to 6C-4 respectively correspond to the first to the fourth scanning operations, and are diagrams illustrating mask patterns to be applied to the image data illustrated in FIG. 6B. More specifically, by applying a mask pattern 505 illustrated in FIG. 6C-1 that corresponds to the first scanning operation, to the image data illustrated in FIG. 6B, recording data used in the first scanning operation is generated. In a similar manner, by applying mask patterns 506, 507, and 508 respectively illustrated in FIGS. 6C-2, 6C-3, and 6C-4, to the image data illustrated in FIG. 6B, respective recording data used in the second, third, and fourth scanning operations are generated.

In these examples, each pixel in the mask patterns respectively illustrated in FIGS. 6C-1 to 6C-4 is assigned any of "00", "01", "10", and "11" as a value indicated by two-bit information (hereinafter, also referred to as a code value).

In this case, as seen by referring to the decode table illustrated in FIG. 7, when a code value is "00", no ink is discharged even if a pixel value in a corresponding pixel is any of "00", "01", "10", and "11". In other words, a code value "00" in a mask pattern corresponds to no permission for ink discharge (the number of ink discharge permitted times being 0). In the following description, a pixel in a mask pattern that is assigned the code value "00" will be also referred to as a print non-permitted pixel.

On the other hand, as seen by referring to the decode table illustrated in FIG. 7, when a code value is "01", if a pixel value in a corresponding pixel is "00", "01", or "10", no ink is discharged, but if a pixel value in a corresponding pixel is "11", ink is discharged. In other words, a code value "01" corresponds to one ink discharge permission among 4 patterns of pixel values ("00", "01", "10", and "11")(the number of ink discharge permitted times being 1).

In addition, when a code value is "10", if a pixel value in a corresponding pixel is "00" or "01", no ink is discharged, but if a pixel value in a corresponding pixel is "10" or "11", ink is discharged. In other words, a code value "10" corresponds to two ink discharge permissions among the 4 patterns of pixel values (the number of ink discharge permitted times being 2).

Furthermore, when a code value is "11", if a pixel value in a corresponding pixel is "00", no ink is discharged, but if a pixel value in a corresponding pixel is "01", "10", or "11", ink is discharged. In other words, a code value "11" corresponds to three ink discharge permissions among the 4 patterns of pixel values (the number of ink discharge permitted times being 3). In addition, in the following description, a pixel in a mask pattern that is assigned any of the code values "01", "10", and "11" will also be referred to as a print permitted pixel.

In this manner, in the mask patterns according to the present exemplary embodiment, any of the numbers of permitted times from 0 to 3 is defined for each pixel.

In this example, a mask pattern including b-bit information that is used in the present exemplary embodiment is set based on the following (Condition 1) and (Condition 2).

(Condition 1)

Here, (2^b)−1 print permitted pixels are set to be arranged in a plurality of pixels arranged at the same position in a plurality of mask patterns. The (2^b)−1 print permitted pixels have numbers of ink discharge permitted times different from one another. More specifically, since b=2 is set in the present exemplary embodiment, among 4 pixels located at the same position in the four mask patterns respectively illustrated in FIGS. 6C-1 to 6C-4, the code values "01", "10", and "11" are respectively allocated to 3 (=2^2−1) pixels (print permitted pixel), and the code value "00" is allocated to the remaining 1 (=4−3) pixel (print non-permitted pixel).

For example, to the pixel 700, the code value "01" is allocated in the mask pattern illustrated in FIG. 6C-3, the code value "10" is allocated in the mask pattern illustrated in FIG. 6C-2, and the code value "11" is allocated in the mask pattern illustrated in FIG. 6C-1. In addition, the code value "00" is allocated in the remaining mask pattern illustrated in FIG. 6C-4. In other words, the pixel 700 is a print permitted pixel in the mask patterns illustrated in FIGS. 6C-1, 6C-2, and 6C-3, and is a print non-permitted pixel in the mask pattern illustrated in FIG. 6C-4.

In addition, to the pixel 701, the code value "01" is allocated in the mask pattern illustrated in FIG. 6C-2, the code value "10" is allocated in the mask pattern illustrated in FIG. 6C-1, and the code value "11" is allocated in the mask pattern illustrated in FIG. 6C-4. In addition, the code value "00" is allocated in the remaining mask pattern illustrated in FIG. 6C-3. In other words, the pixel 701 is a print permitted pixel in the mask patterns illustrated in FIGS. 6C-1, 6C-2, and 6C-4, and is a print non-permitted pixel in the mask pattern illustrated in FIG. 6C-3.

With this configuration, recording data can be generated so that, even if a pixel value in a certain pixel is any of "00", "01", "10", and "11", ink is discharged onto a pixel region corresponding to the pixel, the number of ink discharge times corresponding to the pixel value.

(Condition 2)

In addition, in each of the mask patterns respectively illustrated in FIGS. 6C-1 to 6C-4, about the same number of print permitted pixels corresponding to the code value "01" are arranged. More specifically, in the mask pattern illustrated in FIG. 6C-1, the code value "01" is allocated to four pixels, i.e., the pixels 702, 707, 708, and 713. In addition, in the mask pattern illustrated in FIG. 6C-2, the code value "01" is allocated to four pixels, i.e., the pixels 701, 706, 711, and 712. In addition, in the mask pattern illustrated in FIG. 6C-3, the code value "01" is allocated to four pixels, i.e., the pixels 700, 705, 710, and 715. In addition, in the mask pattern illustrated in FIG. 6C-4, the code value "01" is allocated to four pixels, i.e., the pixels 703, 704, 709, and 714. In other words, in each of the four mask patterns respectively illustrated in FIGS. 6C-1 to 6C-4, four print permitted pixels corresponding to the code value "01" are arranged.

Similarly, in each of the mask patterns respectively illustrated in FIGS. 6C-1 to 6C-4, the same number of print permitted pixels corresponding to the code value "10" are also arranged. Furthermore, in each of the mask patterns respectively illustrated in FIGS. 6C-1 to 6C-4, the same number of print permitted pixels corresponding to the code value "11" are also arranged.

In addition, in these examples, the description has been given of the case in which the same number of print permitted pixels corresponding to each of the code values "01", "10", and "11" are arranged in each mask pattern. Actually, it is sufficient that about the same number of print permitted pixels are arranged.

With this configuration, when recording data are generated by distributing image data to four scanning operations using the mask patterns respectively illustrated in FIGS. 6C-1 to 6C-4, respective printing rates in the four scanning operations can be made approximately equal to one another.

FIGS. 6D-1 to 6D-4 are diagrams illustrating recording data generated by applying the mask patterns respectively illustrated in FIGS. 6C-1 to 6C-4, to the image data illustrated in FIG. 6B.

For example, as for the pixel 700 in the recording data illustrated in FIG. 6D-1 that corresponds to the first scanning operation, a pixel value of the image data is "11" and a code value of the mask pattern is "11". Thus, as seen by referring to the decode table illustrated in FIG. 7, ink discharge ("1") is defined for the pixel 700.

In addition, as for the pixel 701, a pixel value of the image data is "10" and a code value of the mask pattern is "10". Thus, ink discharge ("1") is defined for the pixel 701. In addition, as for the pixel 704, a pixel value of the image data is "11" and a code value of the mask pattern is "00". Thus, ink non-discharge ("0") is defined for the pixel 704.

According to the recording data respectively illustrated in FIGS. 6D-1 to 6D-4 that have been generated in the above-described manner, ink is discharged in the first to fourth scanning operations. For example, as seen from the recording data illustrated in FIG. 6D-1, in the first scanning operation, ink is discharged onto pixel regions on a recording medium that correspond to the pixels 700, 701, 705, 708, 710, and 712.

FIG. 6E is a diagram illustrating a logical sum of the recording data respectively illustrated in FIGS. 6D-1 to 6D-4. By discharging ink according to the recording data respectively illustrated in FIGS. 6D-1 to 6D-4, ink is discharged onto a pixel region corresponding to each pixel, the number of times illustrated in FIG. 6E.

For example, for the pixel 700, ink discharge is defined in the recording data illustrated in FIGS. 6D-1, 6D-2, and 6D-3 that correspond to the first, second, and third scanning operations. Thus, as illustrated in FIG. 6E, ink is discharged onto the pixel region corresponding to the pixel 700, three times in total.

In addition, for the pixel 701, ink discharge is defined in the recording data illustrated in FIGS. 6D-1 and 6D-4 that correspond to the first and fourth scanning operations. Thus, as illustrated in FIG. 6E, ink is discharged onto the pixel region corresponding to the pixel 701, twice in total.

When the recording data illustrated in FIG. 6E and the image data illustrated in FIG. 6B are compared with each other, it can be seen that the recording data is generated so that, in any pixel, ink is discharged the number of discharge times corresponding to a pixel value in the image data. For example, in the pixels 700, 704, 708, and 712, while pixel values in the image data illustrated in FIG. 6B are "11", the numbers of ink discharge times indicated by the logical sum in the generated recording data are also three.

According to the above-described configuration, one-bit recording data to be used in each of a plurality of times of scanning can be generated based on image data and mask patterns each including multiple-bit information.

A data processing procedure according to the present exemplary embodiment will be described in detail below with reference to FIGS. 8 to 12.

Figure 8:
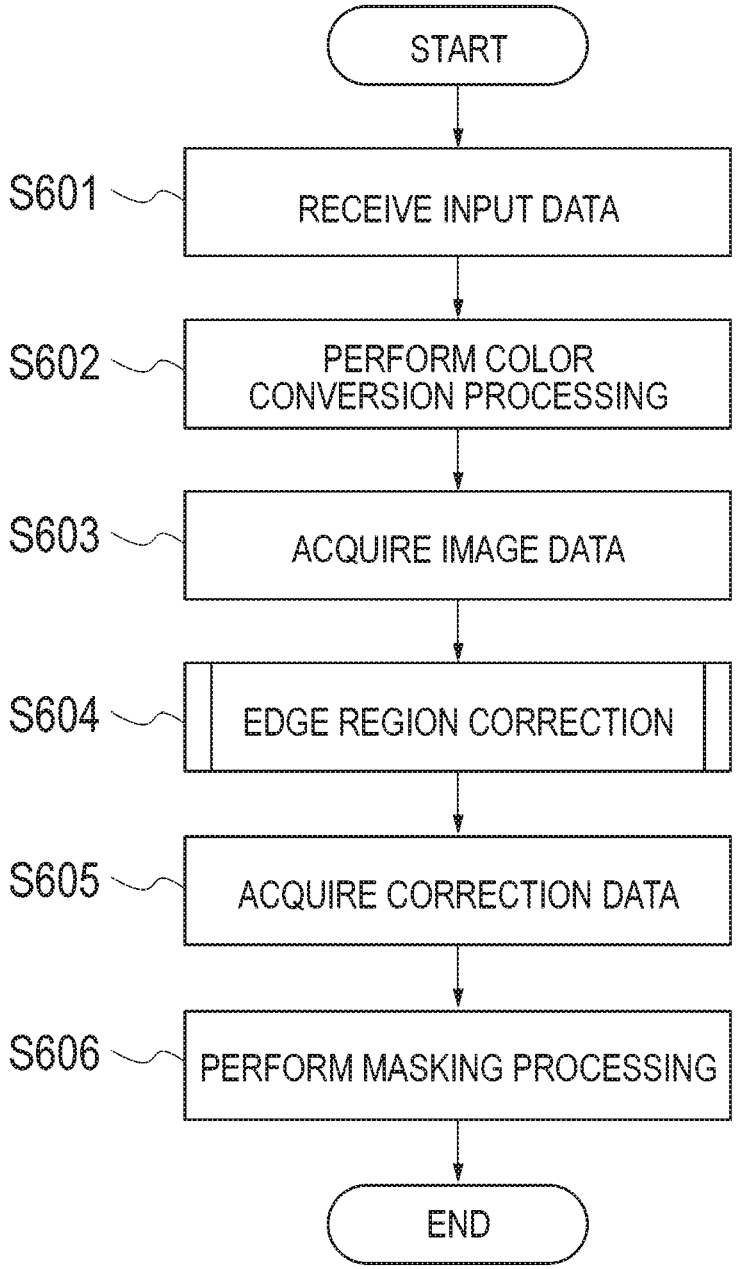
FIG. 8 is a diagram for illustrating a data processing procedure according to an exemplary embodiment.

FIG. 8 is a flowchart of input data processing executed by a CPU according to a control program according to the present exemplary embodiment.

First, in step S601, the image recording device 1000 receives multi-valued data (input data) in an RGB format that has been input from the PC 312, which is a host computer.

Next, in step S602, color conversion processing of converting input data in the RGB format, into data corresponding to a color of ink to be used in recording is performed.

Next, in step S603, image data including two-bit information indicating the number of ink discharge times for each pixel is acquired. In the image data, any of the pixel values "00", "01", "10", and "11" is defined for each pixel as described above.

In addition, in this example, the description has been given of the case in which the image data is generated by executing the color conversion processing in step S602. Alternatively, another processing may be performed after the color conversion processing. For example, image data may be generated by performing quantization processing such as dither processing and error diffusion processing on data having been subjected to the color conversion processing in step S602.

Next, in step S604, correction processing of image data corresponding to an edge region is executed. The edge region correction processing will be described later. The edge region correction processing is processing for an edge of an object such as a character and an image.

Next, in step S605, correction data generated by performing the edge region correction processing on the image data in step S604 is acquired. In addition, similarly to the image data, the correction data also includes two-bit information indicating the number of ink discharge times for each pixel. In the correction data, any of the pixel values "00", "01", "10", and "11" is similarly defined for each pixel.

Then in step S606, masking processing as illustrated in FIGS. 6A, 6B, 6C-1 to 6C-4, 6D-1 to 6D-4, and 6E is executed on the correction data acquired in step S605, and recording data respectively corresponding to the four scanning operations are generated. In the present exemplary embodiment, the masking processing is performed on the correction data by using the mask patterns respectively illustrated in FIGS. 6C-1 to 6C-4, and the decode table illustrated in FIG. 7.

As described above, for example, an edge region of a region onto which recording has been performed with ink of a predetermined color, such as a black character edge, is a region that contacts a region onto which recording has not been performed with ink of the predetermined color, such as a region onto which recording has been performed with ink of another color and a blank region onto which no recording has been performed, and the bleeding of the ink of the predetermined color may occur. Thus, in the present exemplary embodiment, the edge region correction processing is performed on the image data corresponding to the ink of the predetermined color that has been generated in step S603. The edge region correction processing is executed by edge region determination processing for detecting an edge region of image data, and edge region thinning-out processing for reducing the number of ink discharge times indicated by the image data corresponding to the edge region.

In addition, in the present exemplary embodiment, among the respective inks of yellow (Y), magenta (M), photo magenta (Pm), cyan (C), photo cyan (Pc), black (Bk), gray (Gy), photo gray (Pgy), red (R), blue (B), and processing liquid (P), the edge region correction processing is executed only on image data corresponding to the Bk ink for the following reason. In the present exemplary embodiment, for increasing a black density in art paper or the like, processing for increasing the discharge amount of Bk ink more than a usual discharge amount is performed in the generation procedure of image data. As a result, ink bleeding at an edge region is more likely to occur prominently especially in the Bk ink. The present invention, however, is not limited to the configuration of executing the edge region correction processing only for the Bk ink. The edge region correction processing can be appropriately executed for ink of another color, such as Y ink and M ink, depending on the situation.

Figure 9:
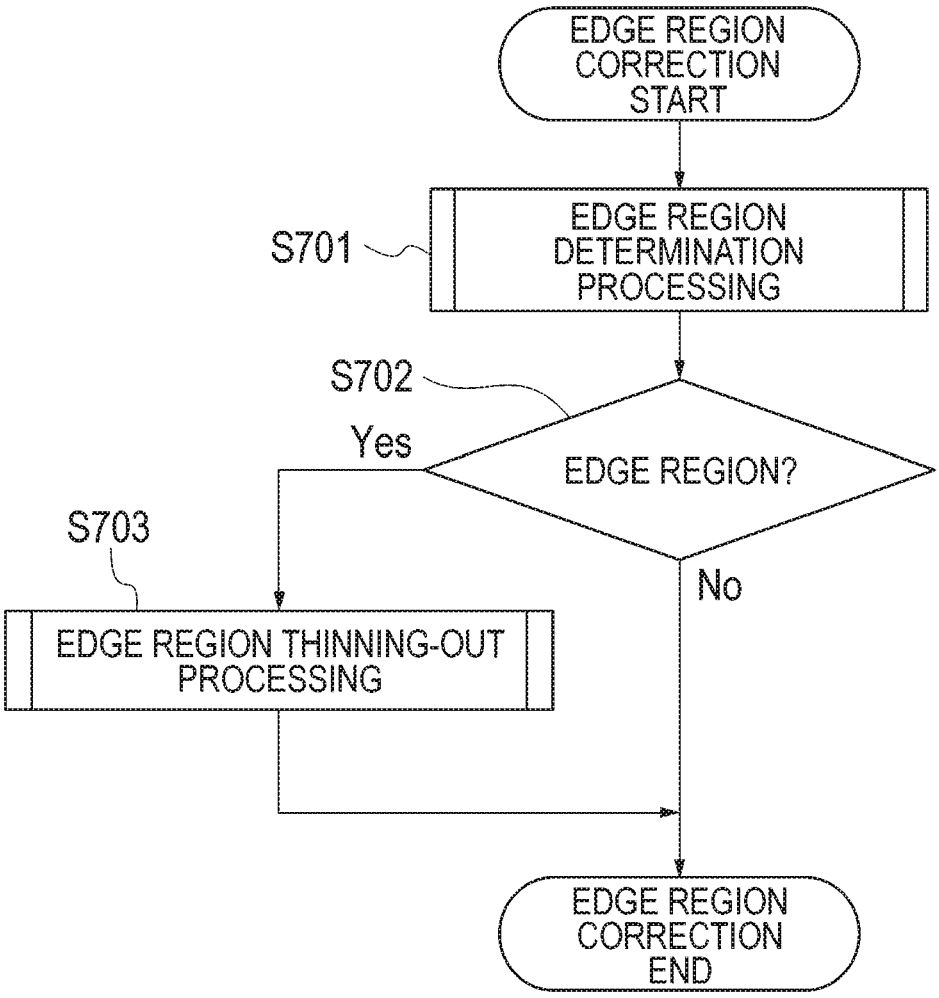
FIG. 9 is a diagram for illustrating edge region correction processing according to an exemplary embodiment.

FIG. 9 is a flowchart of edge region correction processing executed by a CPU according to a control program according to the present exemplary embodiment.

First, when the edge region correction processing is started, in step S701, the edge region determination processing is executed.

Figure 10:
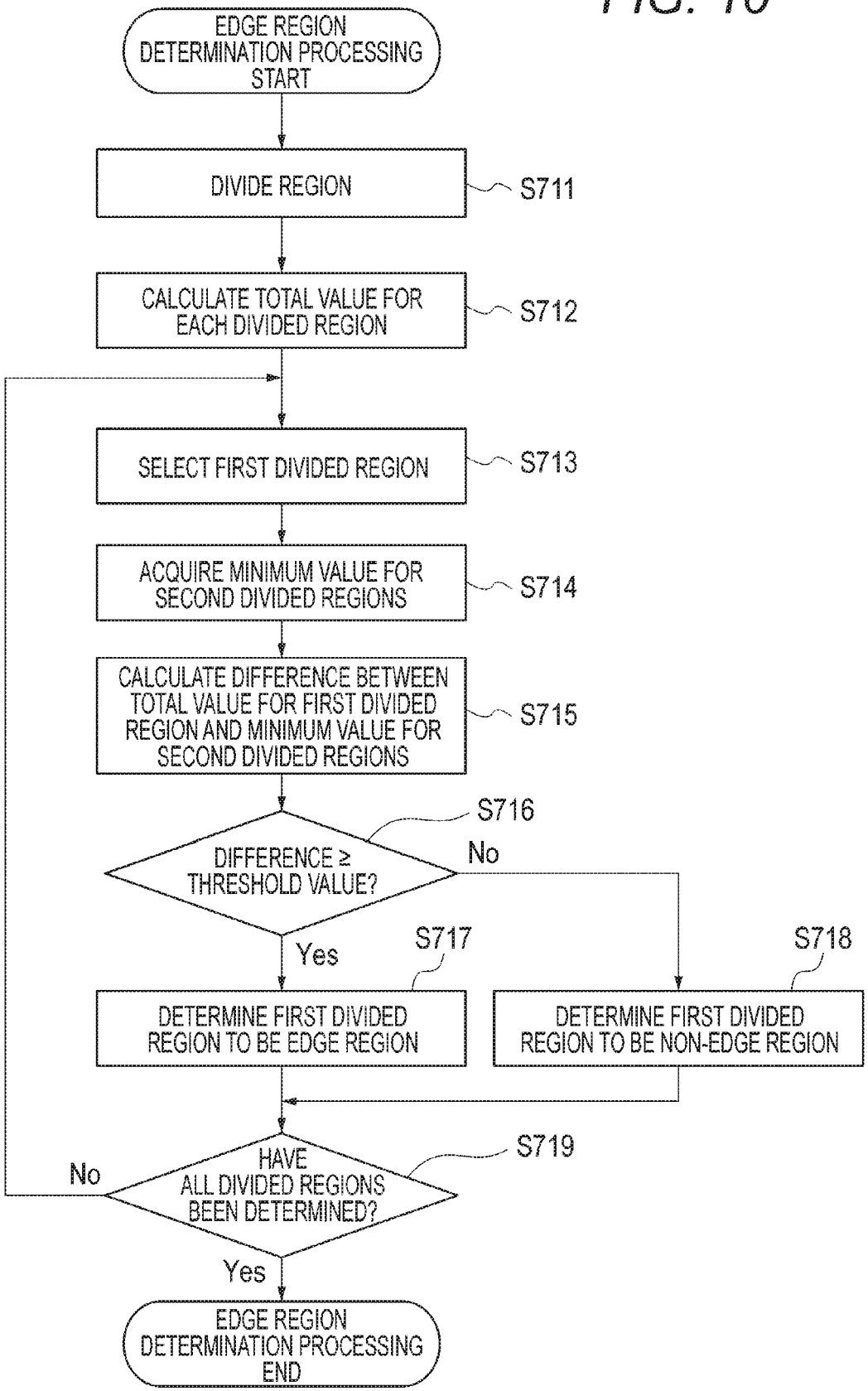
FIG. 10 is a diagram for illustrating edge region determination processing according to an exemplary embodiment.

FIG. 10 is a flowchart of the edge region determination processing executed by a CPU according to a control program according to the present exemplary embodiment.

In the edge region determination processing, first, in step S711, a unit region on a recording medium is divided in the X direction and the Y direction to obtain a plurality of divided regions each including a plurality of pixels. In addition, in the following description, for the sake of simplification, the positive direction and the negative direction in the X direction will be referred to as right and left, respectively. Furthermore, the positive direction and the negative direction in the Y direction will be referred to as up and down, respectively.

Figure 11A:
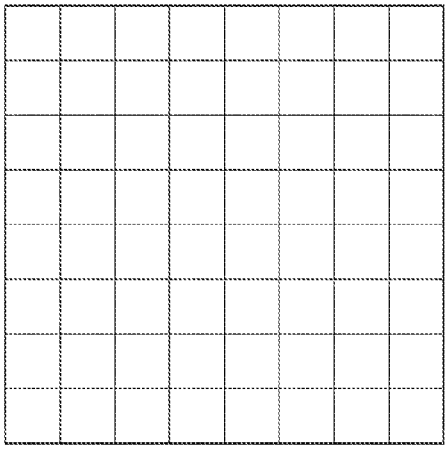
FIGS. 11A and 11B are diagrams for illustrating region dividing processing according to an exemplary embodiment.
Figure 11B:
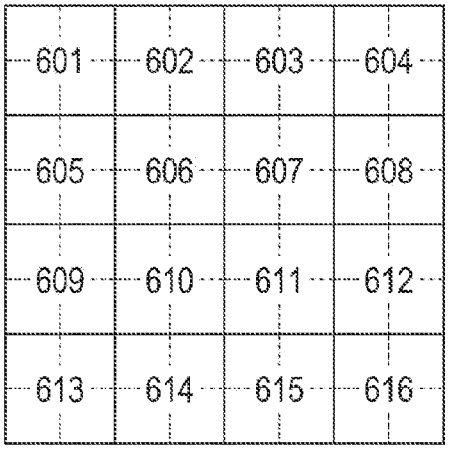
Figure 11B:
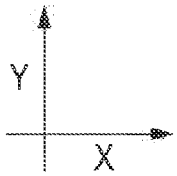

FIGS. 11A and 11B are schematic views for illustrating the region dividing processing in step S711 illustrated in FIG. 10. In addition, in the following description, the case of performing the processing on a region including pixel regions corresponding to 64 pixels constituted by 8 pixels in the X direction illustrated in FIG. 11A and 8 pixels in the Y direction (8 pixels×8 pixels) will be described as an example.

In the present exemplary embodiment, the unit region is divided into a plurality of divided regions, with one divided region being set to a region including pixel regions corresponding to 4 pixels constituted by 2 pixels in the X direction and 2 pixels in the Y direction (2 pixels×2 pixels). For example, among 64 pixels illustrated in FIG. 11A, a divided region 601 illustrated in FIG. 11B is constituted by pixel regions corresponding to 4 pixels of an upper left corner pixel, a pixel on the uppermost row and in the second left column, a pixel in the left end column and on the second uppermost row, and a pixel on the second uppermost row and in the second left column. In a similar manner, divided regions 602 to 616 illustrated in FIG. 11B are each constituted by 4 pixel regions. In this manner, according to the region division in step S711 in the present exemplary embodiment, the region including pixel regions corresponding to pixels constituted by 8 pixels×8 pixels as illustrated in FIG. 11A is divided into 16 divided regions 601 to 616 as illustrated in FIG. 11B.

In addition, in this example, the description has been given of the configuration of setting one divided region to a region including pixel regions corresponding to 4 pixels constituted by 2 pixels×2 pixels. Nevertheless, the number of pixel regions constituting one divided region can be appropriately set to different numbers. For example, one divided region may be set to a region including pixel regions corresponding to 9 pixels constituted by 3 pixels in the X direction and 3 pixels in the Y direction (3 pixels×3 pixels). Alternatively, one divided region may be set to a region including pixel regions corresponding to 8 pixels constituted by 2 pixels in the X direction and 4 pixels in the Y direction (2 pixels×4 pixels).

Next, referring back to FIG. 10, in step S712, for each of the plurality of divided regions, the total value of the respective numbers of ink discharge times for pixel regions that are indicated by image data corresponding to the 4 pixel regions constituting a corresponding divided region is calculated.

As described above, in image data, any of the pixel values "00", "01", "10", and "11" is defined for each pixel. In this case, as described above, when a pixel value is "00", "01", "10", or "11", the number of ink discharge times is 0, 1, 2, or 3, respectively.

Thus, for example, when image data corresponding to the divided region 601 illustrated in FIG. 11B defines pixel values "00", "00", "10", and "10" for pixels corresponding to 4 pixel regions constituting the divided region 601, the total value of the numbers of ink discharge times for the divided region 601 is 4 (=0+0+2+2). In addition, for example, when image data corresponding to the divided region 602 defines pixel values "01", "10", "11", and "10" for pixels corresponding to 4 pixel regions constituting the divided region 602, the total value of the numbers of ink discharge times for the divided region 602 is 8 (=1+2+3+2). In addition, for example, when image data corresponding to the divided region 603 defines pixel values "11", "10", "00", and "01" for pixels corresponding to 4 pixel regions constituting the divided region 603, the total value of the numbers of ink discharge times for the divided region 603 is 6 (=3+2+0+1).

Next, in step S713, one divided region is selected from among the plurality of divided regions as a first divided region serving as a determination target to be determined whether it is an edge region. In the following description, as an example, the divided region 606 is assumed to be selected as the first divided region from among 16 divided regions 601 to 616 illustrated in FIG. 11B.

Next, in step S714, for a plurality of second divided regions, which is a plurality of divided regions adjacent to the first divided region, the minimum value of the total values of the numbers of ink discharge times that have been calculated in step S712 is acquired. In addition, in the present exemplary embodiment, divided regions adjacent to the first divided region in the X direction, divided regions adjacent to the first divided region in the Y direction, and divided regions adjacent to the first divided region in oblique directions intersecting with the X direction and the Y direction are all set as the second divided regions.

For example, when the divided region 606 illustrated in FIG. 11B is selected as the first divided region in step S713, 8 divided regions 601, 602, 603, 605, 607, 609, 610, and 611 that are adjacent to the divided region 606 are set as the second divided regions. In addition, for example, when the total value of the numbers of ink discharge times that has been calculated in step S712 for each of the 7 divided regions 601, 602, 603, 605, 607, 609, and 610 is 3, and the total value of the numbers of ink discharge times that has been calculated in step S712 for the divided region 611 is 0, in step S714, the minimum value 0, which is the total value of the numbers of ink discharge times for the divided region 611, is acquired.

Next, in step S715, a difference between the total value for the first divided region selected in step S713, among the total values of the numbers of ink discharge times that have been calculated in step S712, and the minimum value of the total values of the numbers of ink discharge times for the second divided regions that has been acquired in step S714 is calculated. In addition, the processing is performed by subtracting the minimum value for the second divided regions from the total value for the first divided region.

Next, in step S716, the comparison between the difference calculated in step S715 and a predefined threshold value is performed. When it is determined in step S716 that the difference is equal to or larger than the threshold value (YES in step S716), the processing proceeds to step S717, in which the first divided region selected in step S713 is determined to be an edge region. On the other hand, when it is determined in step S716 that the difference is smaller than the threshold value (NO in step S716), the processing proceeds to step S718, in which the first divided region selected in step S713 is determined to be a non-edge region being not an edge region.

In the processing, the threshold value in step S716 is set to 8 in the present exemplary embodiment for the following reason. When there is a difference by a discharge amount corresponding to 8 or more ink discharge times, between the amount of ink discharged onto a certain divided region and the amount of ink discharged onto other divided regions adjacent to the divided region, ink bleeding prominently occurs at the boundary regions therebetween. Nevertheless, this threshold value can be appropriately set to different values according to the types of ink and a recording medium that are to be used, desired image quality, and the like.

In step S719, it is determined whether all divided regions have been determined whether each of them is an edge region or a non-edge region. When undetermined divided regions are remaining (NO in step S719), the processing returns to step S713, in which one divided region is selected from among the undetermined divided regions as a new first divided region, and similar processing is executed. When all the divided regions have been determined (YES in step S719), the edge region determination processing ends.

Referring back to FIG. 9, the edge region correction processing performed subsequent to the edge region determination processing in step S701 will be described.

In step S702, based on the result of the edge region determination processing illustrated in FIG. 10 that has been executed in step S701, it is determined whether image data corresponding to each divided region is image data corresponding to an edge region. When it is determined in step S702 that the image data is image data corresponding to an edge region (YES in step S702), the processing proceeds to step S703, in which edge region thinning-out processing to be described below is executed on the image data. On the other hand, when it is determined that the image data is image data not corresponding to an edge region, i.e., image data corresponding to a non-edge region (NO in step S702), correction such as thinning-out processing is not especially performed. After these processes are performed, the edge region correction processing in step S604 ends.

Figure 12:
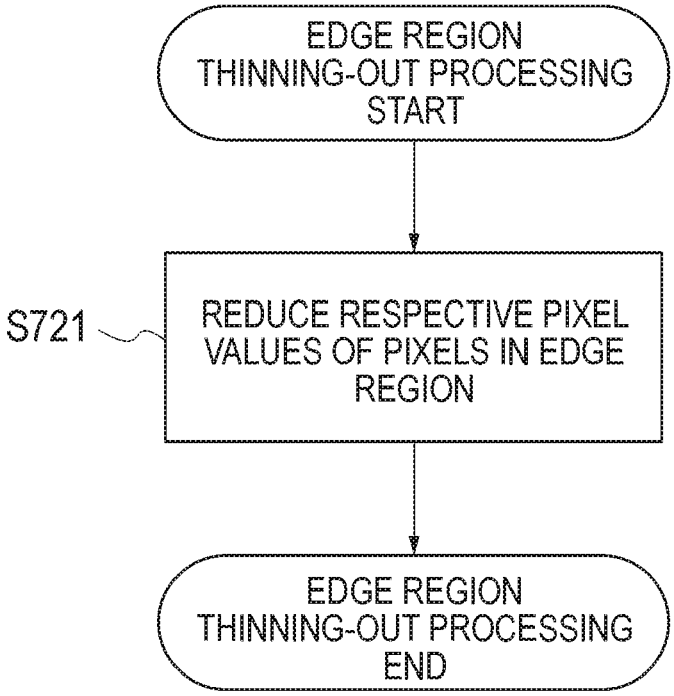
FIG. 12 is a diagram for illustrating edge region thinning-out processing according to an exemplary embodiment.

FIG. 12 is a flowchart of the edge region thinning-out processing executed by a CPU according to a control program according to the present exemplary embodiment.

In the present exemplary embodiment, when the edge region thinning-out processing is started, in step S721, the processing of reducing, by 1, the number of ink discharge times for each of 4 pixel regions constituting a divided region being an edge region is performed. More specifically, when image data defines the pixel value "11" for a certain pixel, the pixel value is reduced to "10". In addition, when image data defines the pixel value "10" for a certain pixel, the pixel value is reduced to "01". Furthermore, when image data defines the pixel value "01" for a certain pixel, the pixel value is reduced to "00".

After such reduction processing of pixel values is executed in step S721, the edge region thinning-out processing ends.

According to the above-described configuration, even in the case of processing image data including multiple-bit information, image data corresponding to an edge region can be suitably corrected, and image quality deterioration caused by ink bleeding can be suppressed.

The procedure of the edge region correction processing according to the present exemplary embodiment will be described in detail below with reference to an example of image data.

Figures 13A, 13B, 13C, 13D:
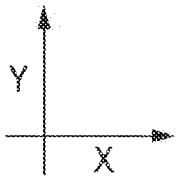
FIGS. 13A, 13B, 13C, and 13D are diagrams for illustrating a procedure of edge region correction processing according to an exemplary embodiment.

FIG. 13A is a diagram illustrating an example of image data to which the edge region correction processing according to the present exemplary embodiment is applied.

In the following description, the case of processing image data that defines the number of ink discharge times for each of pixel regions corresponding to pixels constituted by 8 pixels×8 pixels that are illustrated in FIG. 11A will be described. In other words, as illustrated in FIG. 13A, in the image data, any of the pixel values "00", "01", "10", and "11" is defined for each of 64 pixels constituted by 8 pixels×8 pixels.

First, through the region dividing processing in step S711 in the edge region determination processing in step S701, the region including pixel regions corresponding to pixels constituted by 8 pixels×8 pixels is divided into the 16 divided regions 601 to 616 as illustrated in FIG. 11B.

Next, through the total value calculation processing in step S712, the respective total values of the numbers of ink discharge times for the divided region 601 to 616 are calculated as illustrated in FIG. 13B.

For example, as illustrated in FIG. 13A, the pixel values "01", "01", "00", and "01" are defined for the pixels corresponding to 4 pixel regions constituting the divided region 601. Thus, as illustrated in FIG. 13B, the total value of the numbers of ink discharge times for the divided region 601 is calculated to be 3 (=1+1+0+1).

In addition, as illustrated in FIG. 13A, the pixel values "10", "11", "01", and "11" are defined for the pixels corresponding to 4 pixel regions constituting the divided region 606. Thus, as illustrated in FIG. 13B, the total value of the numbers of ink discharge times for the divided region 606 is calculated to be 9 (=2+3+1+3).

In addition, as illustrated in FIG. 13A, the pixel values "11", "11", "11", and "01" are defined for the pixels corresponding to 4 pixel regions constituting the divided region 607. Thus, as illustrated in FIG. 13B, the total value of the numbers of ink discharge times for the divided region 607 is calculated to be 10 (=3+3+3+1).

Next, through the processing in step S713, one divided region is selected from among the 16 divided regions 601 to 616 illustrated in FIG. 11B, as the first divided region. The case in which the divided region 601 is selected will now be described as an example. In addition, the total value of the numbers of ink discharge times for the divided region 601 is 3 as illustrated FIG. 13B.

Next, in step S714, the divided regions 602, 605, and 606 adjacent to the divided region 601 selected as the first divided region are set as the second divided regions, and the minimum value of the respective total values of the numbers of ink discharge times for the divided regions 602, 605, and 606 is acquired. In this example, as illustrated in FIG. 13B, the respective total values of the numbers of ink discharge times for the divided regions 602, 605, and 606 are 7, 1, and 9. Thus, the total value 1 of the numbers of ink discharge times for the divided region 605 is acquired as the minimum value.

Next, through the processing in step S715, a difference between the total value 3 of the numbers of ink discharge times for the divided region 601 selected as the first divided region, and the minimum value 1 of the total values of the numbers of ink discharge times for the second divided regions that has been acquired in step S714 is calculated to be 2 (=3−1).

Thus, it is determined in step S716 that the difference (2) is smaller than the threshold value (8). Then in step S718, the divided region 601 selected as the first divided region is determined to be a non-edge region.

Then, since the other divided regions 602 to 616 have not been determined whether each of them is an edge region or a non-edge region, through the determination in step S719, the processing returns to step S713.

Then, through the processing in step S713, one divided region is selected from among the remaining 15 divided regions 602 to 616, as the first divided region. The case in which the divided region 606 is selected will now be described as an example. In addition, as illustrated in FIG. 13B, the total value of the numbers of ink discharge times for the divided region 606 is 9.

Next, in step S714, the divided regions 601, 602, 603, 605, 607, 609, 610, and 611 adjacent to the divided region 606 selected as the first divided region are set as the second divided regions, and the minimum value of the respective total values of the numbers of ink discharge times for the divided regions 601, 602, 603, 605, 607, 609, 610, and 611 is acquired. In this example, as illustrated in FIG. 13B, the respective total values of the numbers of ink discharge times for the divided regions 601, 602, 603, 605, 607, 609, 610, and 611 are 3, 7, 11, 1, 10, 0, 0, and 8. Thus, the total value 0 of the numbers of ink discharge times for the divided regions 609 and 610 is acquired as the minimum value.

Next, through the processing in step S715, a difference between the total value 9 of the numbers of ink discharge times for the divided region 606 selected as the first divided region, and the minimum value 0 of the total values of the numbers of ink discharge times for the second divided regions that has been acquired in step S714 is calculated to be 9 (=9−0).

Thus, it is determined in step S716 that the difference (9) is equal to or larger than the threshold value (8). Then in step S717, the divided region 606 selected as the first divided region is determined to be an edge region.

Then, since the other divided regions 602 to 605 and 607 to 616 have not been determined whether each of them is an edge region or a non-edge region, through the determination in step S719, the processing returns to step S713.

Then, through the processing in step S713, one divided region is selected from among the remaining 14 divided regions 602 to 605 and 607 to 616, as the first divided region. The case in which the divided region 607 is selected will now be described as an example. In addition, as illustrated in FIG. 13B, the total value of the numbers of ink discharge times for the divided region 607 is 10.

Next, in step S714, the divided regions 602, 603, 604, 606, 608, 610, 611, and 612 adjacent to the divided region 607 selected as the first divided region are set as the second divided regions, and the minimum value of the respective total values of the numbers of ink discharge times for the divided regions 602, 603, 604, 606, 608, 610, 611, and 612 is acquired. In this example, as illustrated in FIG. 13B, the respective total values of the numbers of ink discharge times for the divided regions 602, 603, 604, 606, 608, 610, 611, and 612 are 7, 11, 12, 9, 11, 0, 8, and 5. Thus, the total value 0 of the numbers of ink discharge times for the divided region 610 is acquired as the minimum value.

Next, through the processing in step S715, a difference between the total value 10 of the numbers of ink discharge times for the divided region 607 selected as the first divided region, and the minimum value 0 of the total values of the numbers of ink discharge times for the second divided regions that has been acquired in step S714 is calculated to be 10 (=10−0).

Thus, it is determined in step S716 that the difference (10) is equal to or larger than the threshold value (8). Then in step S717, the divided region 607 selected as the first divided region is determined to be an edge region.

Then, since the other divided regions 602 to 605 and 608 to 616 have not been determined whether each of them is an edge region or a non-edge region, through the determination in step S719, the processing returns to step S713.

The above-described processing is repeated, and all the divided regions 601 to 616 are determined whether each of them is an edge region or a non-edge region. When the edge region determination processing is performed on the data illustrated in FIGS. 13A and 13B, 3 divided regions of the divided regions 606, 607, and 611 are determined to correspond to edge regions, and 13 divided regions of the remaining divided regions 601 to 605, 608 to 610, and 612 to 616 are determined to correspond to non-edge regions.

Thus, image data corresponding to the divided regions 601 to 605, 608 to 610, and 612 to 616 are determined in step S702 to be image data corresponding to non-edge regions (NO in step S702), so that the thinning-out processing is not performed on the image data.

On the other hand, through the processing in step S702, image data corresponding to the divided regions 606, 607, and 611 are determined to be image data corresponding to edge regions (YES in step S702), and the processing proceeds to step S703. Then in step S721 in the edge region thinning-out processing in step S703, the number of ink discharge times for each pixel region in the divided regions 606, 607, and 611 determined to be edge regions is reduced by 1.

FIG. 13C is a diagram illustrating correction data generated after the execution of the edge region correction processing. In addition, FIG. 13D is a diagram illustrating the total value of the numbers of ink discharge times for each of the divided regions 601 to 616 that are indicated by the correction data generated through the edge region correction processing.

As seen from FIG. 13C, when the edge region correction processing according to the present exemplary embodiment is executed, the numbers of ink discharge times for the divided regions 601 to 605, 608 to 610, and 612 to 616 remain unchanged from the numbers of ink discharge times defined before the edge region correction processing.

For example, as illustrated in FIG. 13A, in the image data before the edge region correction processing, the pixel values "01", "01", "00", and "01" are defined for the respective pixels corresponding to 4 pixel regions constituting the divided region 601 being a non-edge region. In addition, as illustrated in FIG. 13C, in the correction data after the edge region correction processing, the pixel values "01", "01", "00", and "01" are defined for the respective pixels corresponding to 4 pixel regions constituting the divided region 601. Thus, while the total value of the numbers of ink discharge times for the divided region 601 is 3 before the execution of the edge region correction processing, as illustrated in FIG. 13B, the total value can remain at 3 even after the execution of the edge region correction processing, as illustrated in FIG. 13D.

On the other hand, by executing the edge region correction processing according to the present exemplary embodiment, the numbers of ink discharge times for the divided regions 606, 607, and 611 are reduced as compared with those defined before the edge region correction processing.

For example, as illustrated in FIG. 13A, in the image data before the edge region correction processing, the pixel values "10", "11", "01", and "11" are defined for the respective pixels corresponding to 4 pixel regions constituting the divided region 606 being an edge region. Through the processing in step S721, the processing of reducing the pixel values in the respective pixels corresponding to 4 pixel regions constituting the divided region 606 is executed on the image data. Thus, as illustrated in FIG. 13C, in the correction data after the edge region correction processing, the pixel values "01", "10", "00", and "10" are defined for the respective pixels corresponding to 4 pixel regions constituting the divided region 606. As a result, while the total value of the numbers of ink discharge times for the divided region 606 has been 9 before the execution of the edge region correction processing, as illustrated in FIG. 13B, the total value can be reduced to 5 after the execution of the edge region correction processing, as illustrated in FIG. 13D.

In addition, as illustrated in FIG. 13A, in the image data before the edge region correction processing, the pixel values "11", "11", "11", and "01" are defined for the respective pixels corresponding to 4 pixel regions constituting the divided region 607 being an edge region. Through the processing in step S721, the processing of reducing the pixel values in the respective pixels corresponding to 4 pixel regions constituting the divided region 607 is executed on the image data. Thus, as illustrated in FIG. 13C, in the correction data after the edge region correction processing, the pixel values "10", "10", "10", and "00" are defined for the respective pixels corresponding to 4 pixel regions constituting the divided region 607. As a result, while the total value of the numbers of ink discharge times for the divided region 607 has been 10 before the execution of the edge region correction processing, as illustrated in FIG. 13B, the total value can be reduced to 6 after the execution of the edge region correction processing, as illustrated in FIG. 13D.

In addition, as illustrated in FIG. 13A, in the image data before the edge region correction processing, the pixel values "11", "10", "10", and "01" are defined for the respective pixels corresponding to 4 pixel regions constituting the divided region 611 being an edge region. Through the processing in step S721, the processing of reducing the pixel values in the respective pixels corresponding to 4 pixel regions constituting the divided region 611 is executed on the image data. Thus, as illustrated in FIG. 13C, in the correction data after the edge region correction processing, the pixel values "10", "01", "01", and "00" are defined for the respective pixels corresponding to 4 pixel regions constituting the divided region 611. As a result, while the total value of the numbers of ink discharge times for the divided region 611 has been 8 before the execution of the edge region correction processing, as illustrated in FIG. 13B, the total value can be reduced to 4 after the execution of the edge region correction processing, as illustrated in FIG. 13D.

As described above, according to the present exemplary embodiment, it can be confirmed that, even in the case of processing image data including multiple-bit information, image data corresponding to an edge region can be suitably corrected.

Second Exemplary Embodiment

In the above-described first exemplary embodiment, the description has been given of the configuration of the edge region thinning-out processing in which, in image data corresponding to a divided region being an edge region, the respective numbers of ink discharge times for a plurality of pixel regions constituting the divided region are uniformly reduced by 1.

In contrast, in the present exemplary embodiment, the description will be given of the configuration of the edge region thinning-out processing in which, in image data corresponding to a divided region being an edge region, only the number of ink discharge times for a pixel region with the number of ink discharge times being a predetermined number or more, among a plurality of pixel regions constituting the divided region is reduced.

In addition, the description of the parts similar to the above-described first exemplary embodiment will be omitted. In addition, also in the present exemplary embodiment, the description will be given assuming that the divided regions 601 to 616 are as illustrated in FIG. 11B.

When the edge region correction processing is executed according to the first exemplary embodiment, there arises a pixel region for which ink non-discharge is defined after the correction although ink discharge has been defined before the correction. In other words, when the pixel value "01" is defined for a pixel corresponding to a certain pixel region in a divided region being an edge region, since the pixel value is reduced to "00" through the edge region correction, no ink is discharged onto the pixel region. For example, in the correction data illustrated in FIG. 13C, ink non-discharge is defined for 3 pixel regions of a lower left pixel region in the divided region 606, a lower right pixel region in the divided region 607, and a lower right pixel region in the divided region 611.

In this manner, if ink once fails to be discharged onto a pixel region onto which ink has been originally defined to be discharged, an unintended white spot occurs in the pixel region. This may cause image quality deterioration instead of suppressing the deterioration. In view of the foregoing, in the present exemplary embodiment, the edge region thinning-out processing is executed in such a manner as to avoid reducing the number of ink discharge times for a pixel region with the number of ink discharge times being smaller than a predetermined number, even if image data corresponds to a divided region being an edge region.

Figure 14:
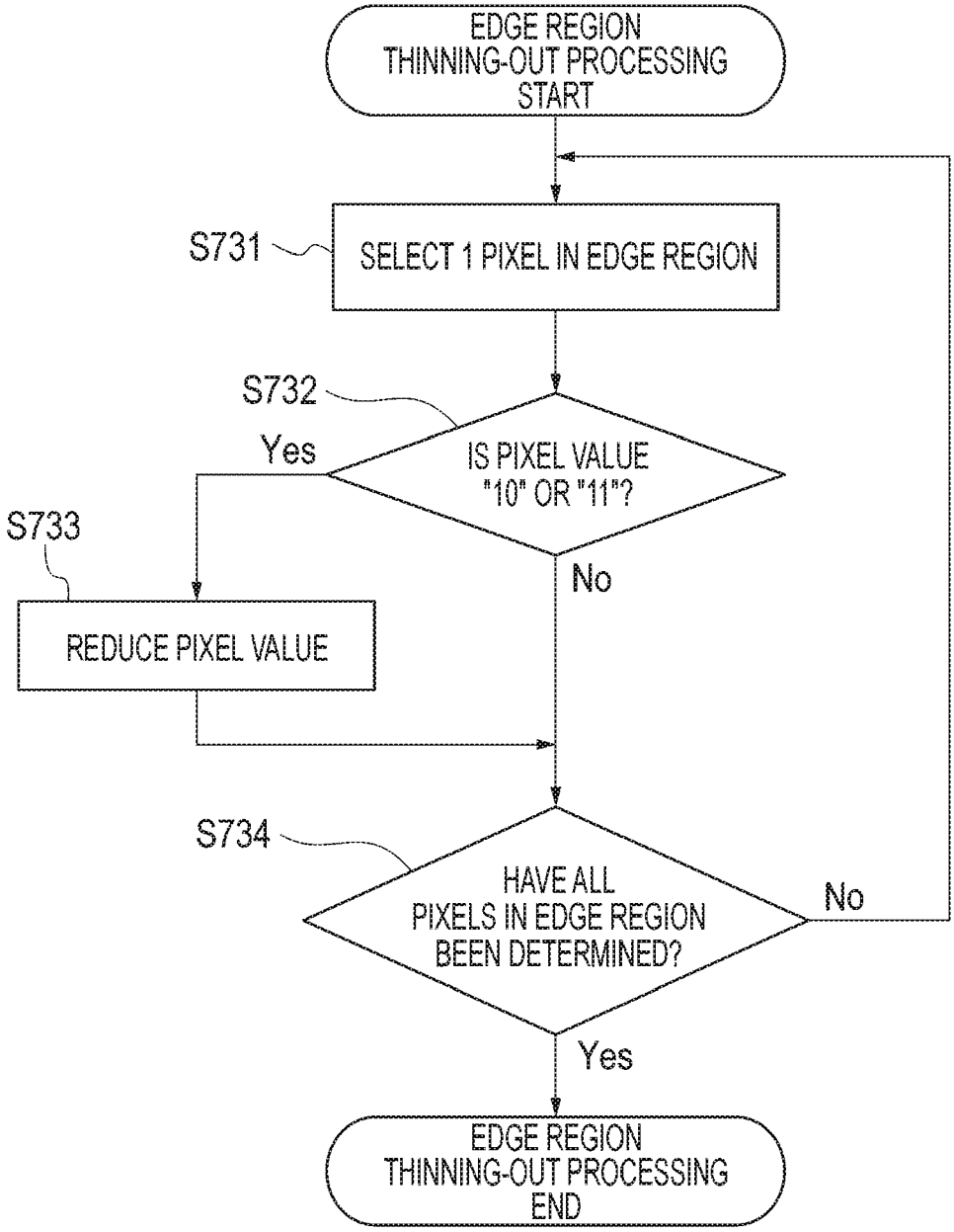
FIG. 14 is a diagram for illustrating edge region thinning-out processing according to an exemplary embodiment.

FIG. 14 is a flowchart of the edge region thinning-out processing executed by a CPU according to a control program according to the present exemplary embodiment.

In the present exemplary embodiment, when the edge region thinning-out processing is started, in step S731, one pixel region is selected from among a plurality of pixel regions constituting a divided region being an edge region.

Next, in step S732, it is determined whether a pixel value defined by the image data before the edge region correction processing for a pixel corresponding to the pixel region selected in step S731 is "10" or "11".

When it is determined in step S732 that the pixel value is "10" or "11" (YES in step S732), the processing proceeds to step S733, the processing of reducing the number of ink discharge times for the pixel region by 1 is performed. More specifically, when the image data defines the pixel value "11" for a certain pixel, the pixel value is reduced to "10". In addition, when the image data defines the pixel value "10" for a certain pixel, the pixel value is reduced to "01". Then, the processing proceeds to step S734.

On the other hand, when it is determined in step S732 that the pixel value is neither "10" nor "11" (the pixel value is "01" or "00") (NO in step S732), the processing proceeds to step S734 without reducing the pixel value for the pixel.

Then in step S734, it is determined whether the determination processing in step S732 has been executed for all the pixel regions included in the divided region being an edge region. When it is determined that there remain pixel regions for which the determination processing in step S732 has not been executed yet (NO in step S734), the processing returns to step S731. Then, one pixel region is selected from among the pixel regions for which the determination processing has not been executed yet, and similar processing is executed on the pixel region. On the other hand, when it is determined in step S734 that the determination processing in step S732 has been executed for all the pixel regions (YES in step S734), the edge region thinning-out processing ends.

With the above-described configuration, in the case of processing image data including multiple-bit information, image data corresponding to an edge region can be corrected so as not to cause a white spot.

The procedure of the edge region correction processing according to the present exemplary embodiment will be described in detail below with reference to an example of image data.

FIG. 15A is a diagram illustrating an example of image data to which the edge region correction processing according to the present exemplary embodiment is applied. In addition, in this example, the description will be given of the case of processing data similar to the image data used for describing the procedure of the edge region correction processing according to the first exemplary embodiment that is illustrated in FIG. 13A.

In the edge region correction processing according to the present exemplary embodiment, the edge region determination processing in step S701 is similar to that in the first exemplary embodiment. Thus, by executing the edge region determination processing on the image data illustrated in FIG. 15A, the total value of the numbers of ink discharge times for each divided region is calculated as illustrated in FIG. 15B. Furthermore, 3 divided regions of divided regions 606, 607, and 611 are determined to correspond to edge regions, and 13 divided regions of the remaining divided regions 601 to 605, 608 to 610, and 612 to 616 are determined to correspond to non-edge regions.

Thus, image data corresponding to the divided regions 601 to 605, 608 to 610, and 612 to 616 are determined in step S702 to be image data corresponding to non-edge regions (NO in step S702), thinning-out processing is not performed on the image data.

On the other hand, image data corresponding to the divided regions 606, 607, and 611 are determined in step S702 to be image data corresponding to edge regions (YES in step S702), and the processing proceeds to step S703. Then in step S703, the edge region thinning-out processing illustrated in FIG. 14 is performed.

FIG. 15C is a diagram illustrating correction data generated after the execution of the edge region correction processing. In addition, FIG. 15D is a diagram illustrating the total value of the numbers of ink discharge times for each of the divided regions 601 to 616 that are indicated by the correction data generated through the edge region correction processing.

As seen from FIG. 15C, when the edge region correction processing according to the present exemplary embodiment is executed, the numbers of ink discharge times for the divided regions 601 to 605, 608 to 610, and 612 to 616 remain unchanged from the numbers of ink discharge times defined before the edge region correction processing.

For example, as illustrated in FIG. 15A, in the image data before the edge region correction processing, the pixel values "01", "01", "00", and "01" are defined for the respective pixels corresponding to 4 pixel regions constituting the divided region 601 being a non-edge region. In addition, as illustrated in FIG. 15C, in the correction data after the edge region correction processing, the pixel values "01", "01", "00", and "01" are defined for the respective pixels corresponding to 4 pixel regions constituting the divided region 601. Thus, while the total value of the numbers of ink discharge times for the divided region 601 is 3 before the execution of the edge region correction processing, as illustrated in FIG. 15B, the total value can remain at 3 even after the execution of the edge region correction processing, as illustrated in FIG. 15D.

On the other hand, by executing the edge region correction processing according to the present exemplary embodiment, the numbers of ink discharge times for the divided regions 606, 607, and 611 are reduced as compared with those defined before the edge region correction processing. Furthermore, at this time, correction can be performed so as not to generate image data that defines ink non-discharge for a pixel region onto which ink has been originally defined to be discharged.

First, when the edge region thinning-out processing is executed, in step S731, one pixel region is selected from among 12 (=4×3) pixel regions constituting the divided regions 606, 607, and 611 being edge regions. The case in which an upper left pixel region in the divided region 606 is selected will now be described as an example.

Next, it is determined whether a pixel value defined for a pixel corresponding to the pixel region selected in step S732 is "10" or "11". As seen from FIG. 15A, since the pixel value "10" is defined for a pixel corresponding to the upper left pixel region in the divided region 606, the processing proceeds to step S733.

Next, in step S733, the number of ink discharge times for the pixel region selected in step S732 is reduced by 1. Thus, as seen from FIG. 15C, the pixel value in the pixel corresponding to the upper left pixel region in the divided region 606 is reduced from "10" to "01".

Then, since there remain pixel regions for which the determination processing in step S732 has not been executed yet, through the determination in step S734, the processing returns to step S731.

Then in step S731, one pixel region is selected from among the remaining 11 pixel regions constituting the divided regions 606, 607, and 611 being edge regions, and for which the determination processing in step S732 has not been executed yet. The case in which the upper right pixel region in the divided region 606 is selected will now be described as an example.

Next, it is determined whether a pixel value defined for a pixel corresponding to the pixel region selected in step S732 is "10" or "11". As seen from FIG. 15A, since the pixel value "11" is defined for a pixel corresponding to the upper right pixel region in the divided region 606, the processing proceeds to step S733.

Next, in step S733, the number of ink discharge times for the pixel region selected in step S732 is reduced by 1. Thus, as seen from FIG. 15C, the pixel value in the pixel corresponding to the upper right pixel region in the divided region 606 is reduced from "11" to "10".

Then, since there remain pixel regions for which the determination processing in step S732 has not been executed yet, through the determination in step S734, the processing returns to step S731.

Then in step S731, one pixel region is selected from among the remaining 10 pixel regions constituting the divided regions 606, 607, and 611 being edge regions, and for which the determination processing in step S732 has not been executed yet. The case in which the lower left pixel region in the divided region 606 is selected will now be described as an example.

Next, it is determined whether a pixel value defined for a pixel corresponding to the pixel region selected in step S732 is "10" or "11". As seen from FIG. 15A, since the pixel value "01" is defined for a pixel corresponding to the lower left pixel region in the divided region 606. Thus, the reduction processing of a pixel value is not executed on the pixel corresponding to the lower left pixel region in the divided region 606. Thus, as seen from FIG. 15C, the pixel value "01" is defined for the pixel corresponding to the lower left pixel region in the divided region 606, similarly to that defined before the edge region correction processing as illustrated in FIG. 15A.

Then, since there remain pixel regions for which the determination processing in step S732 has not been executed yet, through the determination in step S734, the processing returns to step S731.

By repeating the above-described processing, the edge region thinning-out processing is performed on all the pixel regions in the divided regions 606, 607, and 611 being edge regions.

In this example, as illustrated in FIG. 15A, in the image data before the edge region correction processing, the pixel values "10", "11", "01", and "11" are defined for the respective pixels corresponding to 4 pixel regions of the upper left, the upper right, the lower left, and the lower right pixel regions in the divided region 606 being an edge region. Thus, the processing of reducing a pixel value in step S733 is executed on the pixels corresponding to the upper left, the upper right, and the lower right pixel regions in the divided region 606. On the other hand, the processing of reducing a pixel value is not executed on the pixel corresponding to the lower left pixel region in the divided region 606. Thus, as illustrated in FIG. 15C, in the correction data after the edge region correction processing, the pixel values "01", "10", "01", and "10" are defined for the respective pixels corresponding to 4 pixel regions of the upper left, the upper right, the lower left, and the lower right pixel regions in the divided region 606. As a result, while the total value of the numbers of ink discharge times for the divided region 606 has been 9 before the execution of the edge region correction processing, as illustrated in FIG. 15B, the total value can be reduced to 6 after the execution of the edge region correction processing, as illustrated in FIG. 15D. Furthermore, in the correction data after the edge region correction processing, a pixel region of which the number of ink discharge times becomes 0 although ink has been originally defined to be discharged can be prevented from occurring in the divided region 606.

In addition, as illustrated in FIG. 15A, in the image data before the edge region correction processing, the pixel values "11", "11", "11", and "01" are defined for the respective pixels corresponding to 4 pixel regions of the upper left, the upper right, the lower left, and the lower right pixel regions in the divided region 607 being an edge region. Thus, the processing of reducing a pixel value in step S733 is executed on the pixels corresponding to the upper left, the upper right, and the lower left pixel regions in the divided region 607. On the other hand, the processing of reducing a pixel value is not executed on the pixel corresponding to the lower right pixel region in the divided region 607. Thus, as illustrated in FIG. 15C, in the correction data after the edge region correction processing, the pixel values "10", "10", "10", and "01" are defined for the respective pixels corresponding to 4 pixel regions of the upper left, the upper right, the lower left, and the lower right pixel regions in the divided region 607. As a result, while the total value of the numbers of ink discharge times for the divided region 607 has been 10 before the execution of the edge region correction processing, as illustrated in FIG. 15B, the total value can be reduced to 7 after the execution of the edge region correction processing, as illustrated in FIG. 15D. Furthermore, in the correction data after the edge region correction processing, a pixel region of which the number of ink discharge times becomes 0 although ink has been originally defined to be discharged can be prevented from occurring in the divided region 607.

In addition, as illustrated in FIG. 15A, in the image data before the edge region correction processing, the pixel values "11", "10", "10", and "01" are defined for the respective pixels corresponding to 4 pixel regions of the upper left, the upper right, the lower left, and the lower right pixel regions in the divided region 611 being an edge region. Thus, the processing of reducing a pixel value in step S733 is executed on the pixels corresponding to the upper left, the upper right, and the lower left pixel regions in the divided region 611. On the other hand, the processing of reducing a pixel value is not executed on the pixel corresponding to the lower right pixel region in the divided region 611. Thus, as illustrated in FIG. 15C, in the correction data after the edge region correction processing, the pixel values "10", "01", "01", and "01" are defined for the respective pixels corresponding to 4 pixel regions of the upper left, the upper right, the lower left, and the lower right pixel regions in the divided region 611. As a result, while the total value of the numbers of ink discharge times for the divided region 611 has been 8 before the execution of the edge region correction processing, as illustrated in FIG. 15B, the total value can be reduced to 5 after the execution of the edge region correction processing, as illustrated in FIG. 15D. Furthermore, in the correction data after the edge region correction processing, a pixel region of which the number of ink discharge times becomes 0 although ink has been originally defined to be discharged can be prevented from occurring in the divided region 611.

As described above, according to the present exemplary embodiment, it can be confirmed that, in the case of processing image data including multiple-bit information, image data corresponding to an edge region can be suitably corrected while suppressing the occurrence of a white spot.

Third Exemplary Embodiment

In the above-described first and second exemplary embodiments, the description has been given of the configuration of the edge region determination processing in which the minimum value of the total values of the numbers of ink discharge times for a plurality of second divided regions adjacent to a first divided region is acquired as a representative value of the numbers of ink discharge times for the second divided regions, and the acquired minimum value is compared with the total value of the numbers of ink discharge times for the first divided region.

On the other hand, in the present exemplary embodiment, the description will be given of the configuration of edge region determination processing in which an average value of relatively-small total values among the total values of the numbers of ink discharge times for a plurality of second divided regions is acquired as a representative value of the numbers of ink discharge times for the second divided regions, and the acquired average value is compared with the total value of the numbers of ink discharge times for the first divided region.

In addition, the description of the parts similar to the above-described first and second exemplary embodiments will be omitted. In addition, also in the present exemplary embodiment, the description will be given assuming that the divided regions 601 to 616 are as illustrated in FIG. 11B.

In the first and second exemplary embodiments, among the divided regions 601 to 616 illustrated in FIGS. 13B and 15B, the divided regions 606, 607, and 611 have been determined to be edge regions. In this example, the total value (9) of the numbers of discharge times for the divided region 606 has differences equal to or larger than the threshold value from the respective total values (1, 0, and 0) of the numbers of discharge times for the 3 divided regions 605, 609, and 610. Thus, ink bleeding easily occurs at the edge region. Similarly, the total value (8) of the numbers of discharge times for the divided region 611 has differences equal to or larger than the threshold value from the respective total values (0, 0, and 0) of the numbers of discharge times for the 3 divided regions 610, 614, and 615. Thus, ink bleeding easily occurs at the edge region.

On the other hand, the total value (10) of the numbers of discharge times for the divided region 607 has a difference equal to or larger than the threshold value only from the total value (0) of the numbers of discharge times for the 1 divided region 610. Thus, in the divided region 607, an edge degree is lower as compared with those in the divided regions 606 and 611, so that ink bleeding may be less likely to occur in actual recording.

In view of the above-described points, in the present exemplary embodiment, only a divided region in which ink bleeding at an edge region easily occurs in particular is determined to be an edge region.

Figure 16:
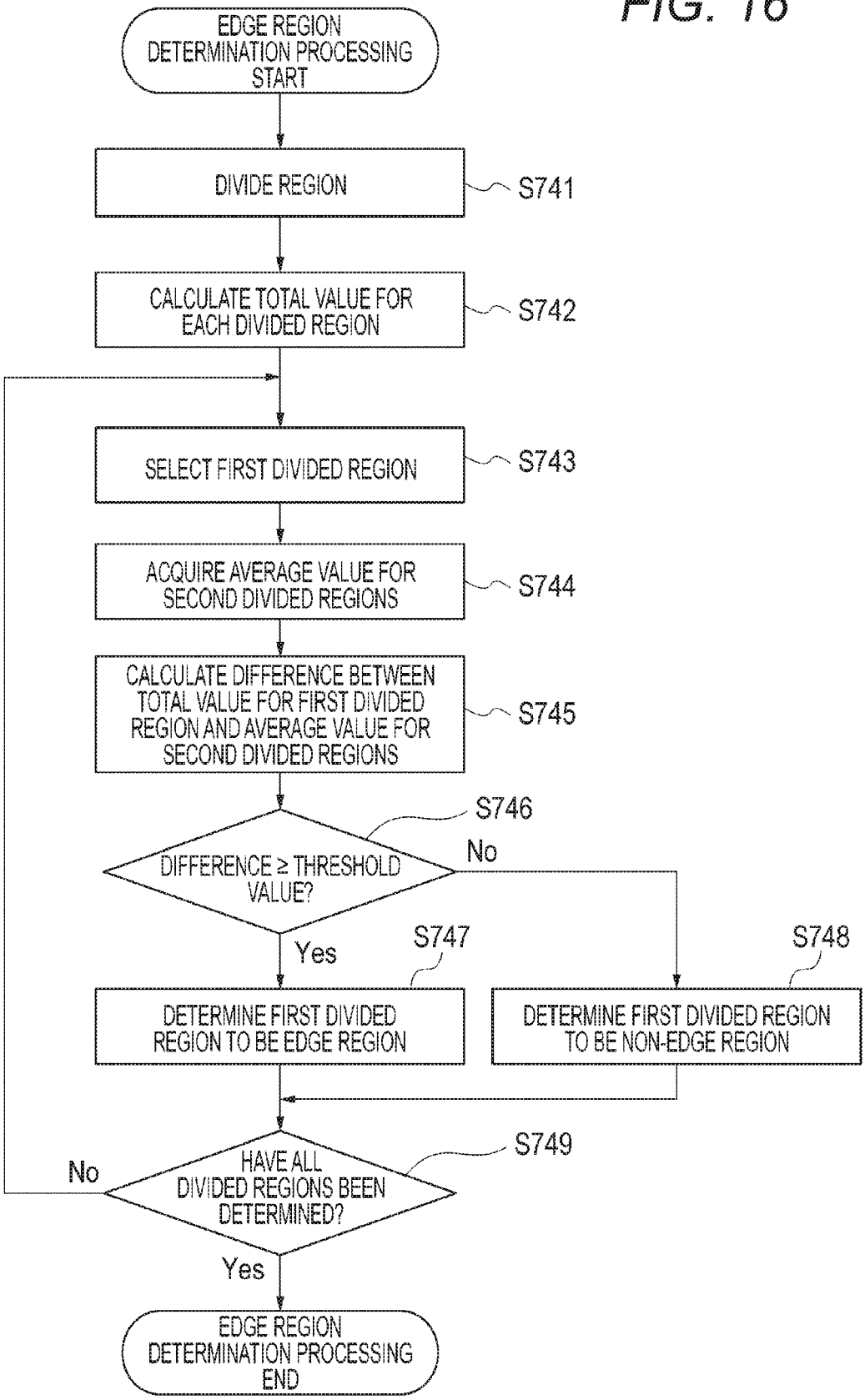
FIG. 16 is a diagram for illustrating edge region determination processing according to an exemplary embodiment.

FIG. 16 is a flowchart of edge region determination processing executed by a CPU according to a control program according to the present exemplary embodiment. In addition, the processing in step S741 to S743 and S746 to S749 in FIG. 16 is similar to the processing in steps S711 to S713 and S716 to S719 in FIG. 10. Thus, the description thereof will be omitted.

In step S744, among a plurality of second divided regions being a plurality of divided regions adjacent to a first divided region, the total values of the numbers of discharge times for a predetermined number of divided regions with smaller total values of the numbers of discharge times than those for the other divided regions are acquired, and an average value of the acquired total values is calculated. In addition, in the present exemplary embodiment, it is assumed that the total values of the numbers of discharge times for 3 divided regions are used for calculating the average value.

For example, the case in which the divided region 606 is selected as the first divided region in step S743 will now be considered. The 8 divided regions 601, 602, 603, 605, 607, 609, 610, and 611 adjacent to the divided region 606 are set as the second divided regions. It is assumed that the total value of the numbers of discharge times for each of the 5 divided regions 601, 602, 603, 605, and 607 is 10, the total value of the numbers of discharge times for the divided region 609 is 3, the total value of the numbers of discharge times for the divided region 610 is 2, and the total value of the numbers of discharge times for the divided region 611 is 1. In step S744, the respective total values 3, 2, and 1 of the numbers of ink discharge times for the divided regions 609, 610, and 611 with smaller total values of the numbers of discharge times than those for the other divided regions are acquired, and the average value of these total values is calculated to be 2 (=(3+2+1)/3).

Next, in step S745, a difference between the total value for the first divided region selected in step S743, among the total values of the numbers of ink discharge times that have been calculated in step S742, and the average value of the numbers of ink discharge times for the second divided regions that has been acquired in step S744 is calculated. In addition, the processing is performed by subtracting the average value for the second divided regions from the total value for the first divided region. Then in the subsequent processing, similarly to the first and second exemplary embodiments, it is determined based on the difference whether the first divided region is an edge region or a non-edge region.

According to the above-described configuration, in the case of processing image data including multiple-bit information, an edge region with a high edge degree and especially-prominent ink bleeding can be determined, and only image data corresponding to the edge region can be corrected.

The procedure of the edge region correction processing according to the present exemplary embodiment will be described in detail below with reference to an example of image data.

Figures 17A, 17B, 17C, 17D:
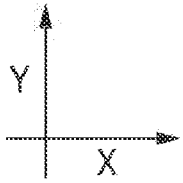
FIGS. 17A, 17B, 17C, and 17D are diagrams for illustrating a procedure of edge region correction processing according to an exemplary embodiment.

FIG. 17A is a diagram illustrating an example of image data to which the edge region correction processing according to the present exemplary embodiment is applied. In addition, in this example, the description will be given of the case of processing data similar to the image data used for describing the procedures of the edge region correction processing according to the first and second exemplary embodiments that are respectively illustrated in FIGS. 13A and 15A. In addition, in the edge region correction processing according to the present exemplary embodiment, the edge region thinning-out processing in step S703 is similar to that in the first and second exemplary embodiments.

In the edge region correction processing according to the present exemplary embodiment, the processing in steps S741 to S742 in the edge region determination processing in step S701 is similar to the processing in steps S711 to S712 in the first and second exemplary embodiments. Thus, by executing the processing in steps S741 to S742 in the edge region determination processing on image data illustrated in FIG. 17A, the total value of the numbers of ink discharge times for each divided region is calculated as illustrated in FIG. 17B.

Next, through the processing in step S743, one divided region is selected from among the 16 divided regions 601 to 616 as the first divided region. The case in which the divided region 606 is selected will now be described as an example. In addition, as illustrated FIG. 17B, the total value of the numbers of ink discharge times for the divided region 606 is 9.

Next, in step S744, the divided regions 601, 602, 603, 605, 607, 609, 610, and 611 adjacent to the divided region 606 selected as the first divided region are set as the second divided regions, and an average value of the total values of the numbers of ink discharge times for 3 second divided regions with smaller total values of the numbers of ink discharge times among the divided regions 601, 602, 603, 605, 607, 609, 610, and 611 is calculated. In this example, as illustrated in FIG. 17B, the respective total values of the numbers of ink discharge times for the divided regions 601, 602, 603, 605, 607, 609, 610, and 611 are 3, 7, 11, 1, 10, 0, 0, and 8. Thus, an average value 0.3 (=(1+0+0)/3) of the respective total values 1, 0, and 0 of the numbers of ink discharge times for the divided regions 605, 609, and 610, which are the 3 second divided regions with smaller total values of the numbers of ink discharge times, is acquired as an average value for the second divided regions.

Next, through the processing in step S745, a difference between the total value 9 of the numbers of ink discharge times for the divided region 606 selected as the first divided region, and the average value 0.3 of the total values of the numbers of ink discharge times for the second divided regions that has been acquired in step S744 is calculated to be 8.7 (=9−0.3).

Thus, it is determined in step S746 that the difference (8.7) is equal to or larger than the threshold value (8). Then in step S747, the divided region 606 selected as the first divided region is determined to be an edge region.

Then, since the other divided regions 601 to 605 and 607 to 616 have not been determined whether each of them is an edge region or a non-edge region, through the determination in step S749, the processing returns to step S743.

Then, through the processing in step S743, one divided region is selected from among the remaining 15 divided regions 601 to 605 and 607 to 616 as the first divided region. The case in which the divided region 607 is selected will now be described as an example. In addition, as illustrated in FIG. 17B, the total value of the numbers of ink discharge times for the divided region 607 is 10.

Next, in step S744, the divided regions 602, 603, 604, 606, 608, 610, 611, and 612 adjacent to the divided region 607 selected as the first divided region are set as the second divided regions, and an average value of the total values of the numbers of ink discharge times for 3 second divided regions with smaller total values of the numbers of ink discharge times among the divided regions 602, 603, 604, 606, 608, 610, 611, and 612 is calculated. In this example, as illustrated in FIG. 17B, the respective total values of the numbers of ink discharge times for the divided regions 602, 603, 604, 606, 608, 610, 611, and 612 are 7, 11, 12, 9, 11, 0, 8, and 5. Thus, an average value (=(7+0+5)/3) of the respective total values 7, 0, and 5 of the numbers of ink discharge times for the divided regions 602, 610, and 612, which are the 3 second divided regions with smaller total values of the numbers of ink discharge times, is acquired as an average value for the second divided regions.

Next, through the processing in step S745, a difference between the total value 10 of the numbers of ink discharge times for the divided region 607 selected as the first divided region, and the average value 4 of the total values of the numbers of ink discharge times for the second divided regions that has been acquired in step S744 is calculated to be 6 (=10−4).

Thus, it is determined in step S746 that the difference (4) is smaller than the threshold value (8). Then in step S748, the divided region 607 selected as the first divided region is determined to be a non-edge region.

Then, since the other divided regions 601 to 605 and 608 to 616 have not been determined whether each of them is an edge region or a non-edge region, through the determination in step S749, the processing returns to step S743.

The above-described processing is repeated, and all the divided regions 601 to 616 are determined whether each of them is an edge region or a non-edge region. When the edge region determination processing is performed on the data illustrated in FIGS. 17A and 17B, 2 divided regions of the divided regions 606 and 611 are determined to correspond to edge regions, and 14 divided regions of the remaining divided regions 601 to 605, 607 to 610, and 612 to 616 are determined to correspond to non-edge regions.

Thus, image data corresponding to the divided regions 601 to 605, 607 to 610, and 612 to 616 are determined in step S702 to be image data corresponding to non-edge regions (NO in step S702), so that the thinning-out processing is not performed on the image data.

On the other hand, through the processing in step S702, image data corresponding to the divided regions 606 and 611 are determined to be image data corresponding to edge regions (YES in step S702), and the processing proceeds to step S703. When the edge region thinning-out processing similar to that in the first exemplary embodiment is performed, in step S721, the number of ink discharge times for each pixel region in the divided regions 606 and 611 determined to be edge regions is reduced by 1.

FIG. 17C is a diagram illustrating correction data generated after the execution of the edge region correction processing according to the present exemplary embodiment. In addition, FIG. 17D is a diagram illustrating the total value of the numbers of ink discharge times for each of the divided regions 601 to 616 that are indicated by the correction data generated through the edge region correction processing according to the present exemplary embodiment.

As seen from FIG. 17C, when the edge region correction processing according to the present exemplary embodiment is performed, the numbers of ink discharge times for the divided regions 601 to 606 and 608 to 616 become the same as the numbers of ink discharge times illustrated in FIG. 13C that have been obtained when the edge region correction processing according to the first exemplary embodiment is executed.

On the other hand, unlike the first exemplary embodiment, according to the present exemplary embodiment, the divided region 607 is determined to be a non-edge region. Thus, as seen from FIG. 17C, when the edge region correction processing according to the present exemplary embodiment is performed, the number of ink discharge times for the divided region 607 remains unchanged from the number of discharge times defined before the edge region correction processing.

More specifically, as illustrated in FIG. 17A, in the image data before the edge region correction processing, the pixel values "11", "11", "11", and "01" are defined for the respective pixels corresponding to 4 pixel regions constituting the divided region 607 being a non-edge region. In addition, as illustrated in FIG. 17C, in the correction data after the edge region correction processing, the pixel values "11", "11", "11", and "01" are consistently defined for the respective pixels corresponding to 4 pixel regions constituting the divided region 607. Thus, while the total value of the numbers of ink discharge times for the divided region 607 is 10 before the execution of the edge region correction processing, as illustrated in FIG. 17B, the total value can remain at 10 even after the execution of the edge region correction processing, as illustrated in FIG. 17D.

This is for the following reason. Although the number of ink discharge times 0 for the divided region 610 adjacent to the divided region 607 is small, the respective numbers of ink discharge times for the other adjacent divided regions 602, 603, 604, 606, 608, 611, and 612 are relatively large. Thus, the average value calculated in step S744 becomes a large value to a certain degree. With this configuration, the edge region determination processing can be executed so that, among divided regions adjacent to a predetermined divided region, regions with relatively smaller numbers of ink discharge times do not exist so many, and when ink bleeding influence at an edge region may be relatively small, the predetermined divided region is likely to be determined to be a non-edge region.

As described above, according to the present exemplary embodiment, it can be confirmed that, in the case of processing image data including multiple-bit information, image data corresponding to an edge region where ink bleeding becomes especially prominent can be suitably corrected.

Fourth Exemplary Embodiment

In the first exemplary embodiment, the description has been given of the configuration of the edge region thinning-out processing in which the numbers of ink discharge times for a plurality of pixel regions in a divided region being an edge region are uniformly reduced by 1.

In contrast, in the present exemplary embodiment, the description will be given of the configuration of the edge region thinning-out processing in which different reduction processes of the number of ink discharge times are performed depending on the position of a pixel region in a divided region being an edge region.

In addition, the description of the parts similar to the above-described first to third exemplary embodiments will be omitted. In addition, also in the present exemplary embodiment, the description will be given assuming that the divided regions 601 to 616 are as illustrated in FIG. 11B.

When the edge region thinning-out processing according to the first exemplary embodiment is executed, as illustrated in FIGS. 13A and 13C, all the pixel values in the respective pixels corresponding to 4 pixel regions included in the divided region 606 are reduced. In this example, among the 4 pixel regions in the divided region 606, the upper left, the lower left, and the lower right pixel regions are each adjacent to a divided region with a relatively small number of ink discharge times. Thus, ink bleeding at an edge region may occur prominently.

On the other hand, the upper right pixel region in the divided region 606 is not adjacent to a divided region with a relatively small number of ink discharge times. Thus, as for the upper right pixel region in the divided region 606, ink bleeding may be less likely to occur even if the number of ink discharge times is not reduced.

In view of the above-described points, in the present exemplary embodiment, edge region thinning-out processing is executed in such a manner that, when a certain pixel region in a divided region being an edge region is not adjacent to a divided region with a relatively small number of ink discharge times, the number of ink discharge times for a pixel corresponding to the pixel region is not reduced.

Figure 18:
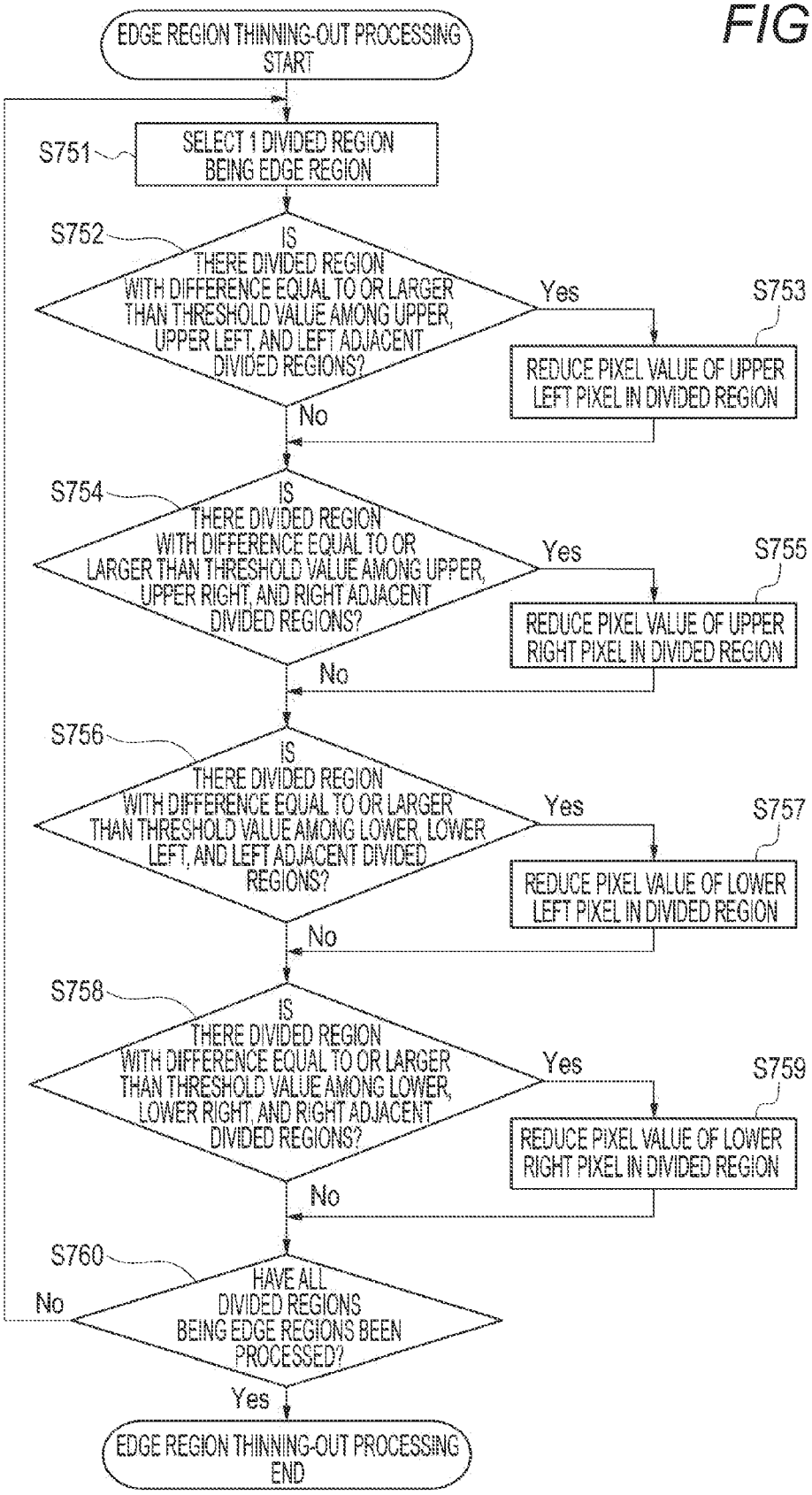
FIG. 18 is a diagram for illustrating edge region thinning-out processing according to an exemplary embodiment.

FIG. 18 is a flowchart of the edge region thinning-out processing executed by a CPU according to a control program according to the present exemplary embodiment.

In the present exemplary embodiment, when the edge region thinning-out processing is started, in step S751, one divided region is selected from among divided regions being edge regions.

Next, in step S752, it is determined whether there is a divided region with a difference in the total amount of the ink discharge amount that is equal to or larger than the threshold value 8, with the divided region selected in step S751, among 3 divided regions of the upper divided region, the upper left divided region, and the left divided region that are adjacent to the divided region selected in step S751.

When it is determined that the difference in the total amount of the ink discharge amount with the divided region selected in step S751 is equal to or larger than the threshold value in at least one divided region of the 3 divided regions of the upper, the upper left, and the left adjacent divided regions (YES in step S752), the processing proceeds to step S753. Then in step S753, the number of ink discharge times for the upper left pixel region in the divided region selected in step S751 is reduced by 1. More specifically, when the image data defines the pixel value "11" for a pixel corresponding to the upper left pixel region in the divided region selected in step S751, the pixel value is reduced to "10". In addition, when the image data defines the pixel value "10" for the pixel corresponding to the upper left pixel region in the divided region selected in step S751, the pixel value is reduced to "01". In addition, when the image data defines the pixel value "01" for the pixel corresponding to the upper left pixel region in the divided region selected in step S751, the pixel value is reduced to "00". Then, the processing proceeds to step S754.

On the other hand, when it is determined that the difference in the total amount of the ink discharge amount with the divided region selected in step S751 is smaller than the threshold value in all divided regions of the 3 divided regions of the upper, the upper left, and the left adjacent divided regions (NO in step S752), the processing proceeds to step S754, without performing the reduction processing on the pixel corresponding to the upper left pixel region in the divided region selected in step S751.

Next, in step S754, it is determined whether there is a divided region with a difference in the total amount of the ink discharge amount that is equal to or larger than the threshold value 8, with the divided region selected in step S751, among 3 divided regions of the upper divided region, the upper right divided region, and the right divided region that are adjacent to the divided region selected in step S751.

When it is determined that the difference in the total amount of the ink discharge amount with the divided region selected in step S751 is equal to or larger than the threshold value in at least one divided region of the 3 divided regions of the upper, the upper right, and the right adjacent divided regions (YES in step S754), the processing proceeds to step S755. Then in step S755, the number of ink discharge times for the upper right pixel region in the divided region selected in step S751 is reduced by 1. More specifically, when the image data defines the pixel value "11" for a pixel corresponding to the upper right pixel region in the divided region selected in step S751, the pixel value is reduced to "10". In addition, when the image data defines the pixel value "10" for the pixel corresponding to the upper right pixel region in the divided region selected in step S751, the pixel value is reduced to "01". In addition, when the image data defines the pixel value "01" for the pixel corresponding to the upper right pixel region in the divided region selected in step S751, the pixel value is reduced to "00". Then, the processing proceeds to step S756.

On the other hand, when it is determined that the difference in the total amount of the ink discharge amount with the divided region selected in step S751 is smaller than the threshold value in all divided regions of the 3 divided regions of the upper, the upper right, and the right adjacent divided regions (NO in step S754), the processing proceeds to step S756, without performing the reduction processing on the pixel corresponding to the upper right pixel region in the divided region selected in step S751.

Next, in step S756, it is determined whether there is a divided region with a difference in the total amount of the ink discharge amount that is equal to or larger than the threshold value 8, with the divided region selected in step S751, among 3 divided regions of the lower divided region, the lower left divided region, and the left divided region that are adjacent to the divided region selected in step S751.

When it is determined that the difference in the total amount of the ink discharge amount with the divided region selected in step S751 is equal to or larger than the threshold value in at least one divided region of the 3 divided regions of the lower, the lower left, and the left adjacent divided regions (YES in step S756), the processing proceeds to step S757. Then in step S757, the number of ink discharge times for the lower left pixel region in the divided region selected in step S751 is reduced by 1. More specifically, when the image data defines the pixel value "11" for a pixel corresponding to the lower left pixel region in the divided region selected in step S751, the pixel value is reduced to "10". In addition, when the image data defines the pixel value "10" for the pixel corresponding to the lower left pixel region in the divided region selected in step S751, the pixel value is reduced to "01". In addition, when the image data defines the pixel value "01" for the pixel corresponding to the lower left pixel region in the divided region selected in step S751, the pixel value is reduced to "00". Then, the processing proceeds to step S758.

On the other hand, when it is determined that the difference in the total amount of the ink discharge amount with the divided region selected in step S751 is smaller than the threshold value in all divided regions of the 3 divided regions of the lower, the lower left, and the left adjacent divided regions (NO in step S756), the processing proceeds to step S758, without performing the reduction processing on the pixel corresponding to the lower left pixel region in the divided region selected in step S751.

Next, in step S758, it is determined whether there is a divided region with a difference in the total amount of the ink discharge amount that is equal to or larger than the threshold value 8, with the divided region selected in step S751, among 3 divided regions of the lower divided region, the lower right divided region, and the right divided region that are adjacent to the divided region selected in step S751.

When it is determined that the difference in the total amount of the ink discharge amount with the divided region selected in step S751 is equal to or larger than the threshold value in at least one divided region of the 3 divided regions of the lower, the lower right, and the right adjacent divided regions (YES in step S758), the processing proceeds to step S759. Then in step S759, the number of ink discharge times for the lower right pixel region in the divided region selected in step S751 is reduced by 1. More specifically, when the image data defines the pixel value "11" for a pixel corresponding to the lower right pixel region in the divided region selected in step S751, the pixel value is reduced to "10". In addition, when the image data defines the pixel value "10" for the pixel corresponding to the lower right pixel region in the divided region selected in step S751, the pixel value is reduced to "01". In addition, when the image data defines the pixel value "01" for the pixel corresponding to the lower right pixel region in the divided region selected in step S751, the pixel value is reduced to "00". Then, the processing proceeds to step S760.

On the other hand, when it is determined that the difference in the total amount of the ink discharge amount with the divided region selected in step S751 is smaller than the threshold value in all divided regions of the 3 divided regions of the lower, the lower right, and the right adjacent divided regions (NO in step S758), the processing proceeds to step S760, without performing the reduction processing on the pixel corresponding to the lower right pixel region in the divided region selected in step S751.

Then in step S760, it is determined whether the processing in steps S752 to S759 has been executed on all the divided regions being edge regions. When it is determined that there remains unexecuted divided regions (NO in step S760), the processing returns to step S751. Then, one divided region is selected from among the unexecuted divided regions, and similar processing is executed on the divided region. On the other hand, when it is determined in step S760 that the processing has been executed on all the divided regions being edge regions (YES in step S760), the edge region thinning-out processing ends.

According to the above-described configuration, in the case of processing image data including multiple-bit information, different correction processes can be executed on image data corresponding to divided regions being edge regions, depending on the position of a pixel region in a divided region.

The procedure of the edge region correction processing according to the present exemplary embodiment will be described in detail below with reference to an example of image data.

FIG. 19A is a diagram illustrating an example of image data to which the edge region correction processing according to the present exemplary embodiment is applied. In addition, in this example, the description will be given of the case of processing data similar to the image data used for describing the procedure of the edge region correction processing according to the first exemplary embodiment that is illustrated in FIG. 13A.

In the edge region correction processing according to the present exemplary embodiment, the edge region determination processing in step S701 is similar to that in the first exemplary embodiment. Thus, by executing the edge region determination processing on the image data illustrated in FIG. 19A, the total value of the numbers of ink discharge times for each divided region is calculated as illustrated in FIG. 19B. Furthermore, 3 divided regions of divided regions 606, 607, and 611 are determined to correspond to edge regions, and 13 divided regions of the remaining divided regions 601 to 605, 608 to 610, and 612 to 616 are determined to correspond to non-edge regions.

Thus, image data corresponding to the divided regions 601 to 605, 608 to 610, and 612 to 616 are determined in step S702 to be image data corresponding to non-edge regions (NO in step S702), so that the thinning-out processing is not performed on the image data.

On the other hand, through the processing in step S702, image data corresponding to the divided regions 606, 607, and 611 are determined to be image data corresponding to edge regions (YES in step S702), and the processing proceeds to step S703. Then in step S703, the edge region thinning-out processing illustrated in FIG. 18 is performed.

FIG. 19C is a diagram illustrating correction data generated after the execution of the edge region correction processing. In addition, FIG. 19D is a diagram illustrating the total value of the numbers of ink discharge times for each of the divided regions 601 to 616 that are indicated by the correction data generated through the edge region correction processing.

As seen from FIG. 19C, when the edge region correction processing according to the present exemplary embodiment is executed, the numbers of ink discharge times for the divided regions 601 to 605, 608 to 610, and 612 to 616 remain unchanged from the numbers of ink discharge times defined before the edge region correction processing.

For example, as illustrated in FIG. 19A, in the image data before the edge region correction processing, the pixel values "01", "01", "00", and "01" are defined for the respective pixels corresponding to 4 pixel regions constituting the divided region 601 being a non-edge region. In addition, as illustrated in FIG. 19C, in the correction data after the edge region correction processing, the pixel values "01", "01", "00", and "01" are defined for the respective pixels corresponding to 4 pixel regions constituting the divided region 601. Thus, while the total value of the numbers of ink discharge times for the divided region 601 is 3 before the execution of the edge region correction processing, as illustrated in FIG. 19B, the total value can remain at 3 even after the execution of the edge region correction processing, as illustrated in FIG. 19D.

On the other hand, by executing the edge region correction processing according to the present exemplary embodiment, the numbers of ink discharge times for the divided regions 606, 607, and 611 are reduced as compared with those defined before the edge region correction processing. Furthermore, at this time, correction can be performed in such a manner that, when a pixel region in a divided region being an edge region is adjacent to a divided region with a large discharge amount, the number of ink discharge times for the pixel region is not reduced.

First, when the edge region thinning-out processing is executed, in step S751, one divided region is selected from among the divided regions 606, 607, and 611 being edge regions. The case in which the divided region 606 is selected will now be described as an example.

Next, in step S752, it is determined whether there is a divided region with a difference in the total value of the numbers of ink discharge times with the divided region 606 that is equal to or larger than the threshold value (8), among the upper divided region 602, the upper left divided region 601, and the left divided region 605 that are adjacent to the divided region 606.

In this example, as seen from FIG. 19B, the total value of the numbers of ink discharge times for the divided region 606 is 9. On the other hand, the total value of the numbers of ink discharge times for the left divided region 605 adjacent to the divided region 606 is 1. Thus, the difference in the total value of the numbers of ink discharge times between the divided regions 606 and 605 is 8 (=9−1). Thus, it is determined that there is a divided region with a difference equal to or larger than the threshold value (YES in step S752), and the processing proceeds to step S753.

Then in step S753, the processing of reducing the number of ink discharge times for the upper left pixel region in the divided region 606 is executed. As seen from FIG. 19A, the pixel value "10" is defined for the pixel corresponding to the upper left pixel region in the divided region 606. Thus, as illustrated in FIG. 19C, the pixel value in the pixel corresponding to the upper left pixel region in the divided region 606 is reduced to "01".

Next, in step S754, it is determined whether there is a divided region with a difference in the total value of the numbers of ink discharge times with the divided region 606 that is equal to or larger than the threshold value (8), among the upper divided region 602, the upper right divided region 603, and the right divided region 607 that are adjacent to the divided region 606.

In this example, as seen from FIG. 19B, the total value of the numbers of ink discharge times for the divided region 606 is 9. On the other hand, the respective total values of the numbers of ink discharge times for the divided regions 602, 603, and 607 are 7, 11, and 10. Thus, it is determined that there is no divided region with a difference in the total value of the numbers of discharge times with the divided region 606 that is equal to or larger than the threshold value (NO in step S754). Thus, the processing of reducing the number of ink discharge times is not executed on the upper right pixel region in the divided region 606. As a result, as illustrated in FIG. 19C, even after the execution of the edge region correction processing, the pixel value "11" is consistently defined for the pixel corresponding to the upper right pixel region in the divided region 606, being unchanged from the pixel value defined before the execution of the edge region correction processing.

Next, in step S756, it is determined whether there is a divided region with a difference in the total value of the numbers of ink discharge times with the divided region 606 that is equal to or larger than the threshold value (8), among the lower divided region 610, the lower left divided region 609, and the left divided region 605 that are adjacent to the divided region 606.

In this example, as seen from FIG. 19B, the total value of the numbers of ink discharge times for the divided region 606 is 9. On the other hand, the respective total values of the numbers of ink discharge times for the lower left divided region 609 and the lower divided region 610 that are adjacent to the divided region 606 are 0. Thus, the difference in the total value of the numbers of ink discharge times between the divided region 606 and the divided regions 609 and 610 is 9 (=9−0). Thus, it is determined that there is a divided region with a difference equal to or larger than the threshold value (YES in step S756), and the processing proceeds to step S757.

Then in step S757, the processing of reducing the number of ink discharge times for the lower left pixel region in the divided region 606 is executed. As seen from FIG. 19A, the pixel value "01" is defined for the pixel corresponding to the lower left pixel region in the divided region 606. Thus, as illustrated in FIG. 19C, the pixel value in the pixel corresponding to the lower left pixel region in the divided region 606 is reduced to "00".

Next, in step S758, it is determined whether there is a divided region with a difference in the total value of the numbers of ink discharge times with the divided region 606 that is equal to or larger than the threshold value 8, among the lower divided region 610, the lower right divided region 611, and the right divided region 607 that are adjacent to the divided region 606.

In this example, as seen from FIG. 19B, the total value of the numbers of ink discharge times for the divided region 606 is 9. On the other hand, the total value of the numbers of ink discharge times for the lower divided region 610 adjacent to the divided region 606 is 0. Thus, the difference in the total value of the numbers of ink discharge times between the divided regions 606 and 610 is 9 (=9−0). Thus, it is determined that there is a divided region with a difference equal to or larger than the threshold value (YES in step S758), and the processing proceeds to step S759.

Then in step S759, the processing of reducing the number of ink discharge times for the lower right pixel region in the divided region 606 is executed. As seen from FIG. 19A, the pixel value "11" is defined for the pixel corresponding to the lower right pixel region in the divided region 606. Thus, as illustrated in FIG. 19C, the pixel value in the pixel corresponding to the lower right pixel region in the divided region 606 is reduced to "10".

Then, since there remain divided regions being edge regions that have not been subjected to the processing in steps S752 to S759 (divided regions 607 and 611), through the determination in step S760, the processing returns to step S751.

By repeating the above-described processing, the edge region thinning-out processing is performed on all the divided regions 606, 607, and 611 being edge regions.

In this example, as illustrated in FIG. 19A, in the image data before the edge region correction processing, the pixel values "10", "11", "01", and "11" are defined for the respective pixels corresponding to 4 pixel regions of the upper left, the upper right, the lower left, and the lower right pixel regions in the divided region 606 being an edge region. At positions adjacent to the 3 pixel regions of the upper left, the lower left, and the lower right pixel regions among the 4 pixel regions in the divided region 606, there are divided regions with a difference in the total value of the numbers of ink discharge times that is equal to or larger than the threshold value. Thus, in the respective steps S753, S757, and S759, the processing of reducing pixel values is executed on the pixels corresponding to the upper left, the lower left, and the lower right pixel regions in the divided region 606. On the other hand, at a position adjacent to the upper right pixel region in the divided region 606, there is no divided region with a difference in the total value of the numbers of ink discharge times that is equal to or larger than the threshold value. Thus, the processing of reducing a pixel value is not executed on the pixel corresponding to the upper right pixel region in the divided region 606. As a result, in the correction data after the edge region correction processing that is illustrated in FIG. 19C, the pixel values "01", "11", "00", and "10" are defined for the respective pixels corresponding to 4 pixel regions of the upper left, the upper right, the lower left, and the lower right pixel regions in the divided region 606. Thus, while the total value of the numbers of ink discharge times for the divided region 606 has been 9 before the execution of the edge region correction processing, as illustrated in FIG. 19B, the total value can be reduced to 6 after the execution of the edge region correction processing, as illustrated in FIG. 19D. Furthermore, the edge region correction processing can be executed in such a manner that the number of ink discharge times is not reduced for the upper right pixel region in the divided region 606, which is not adjacent to a divided region with a difference in the total value of the numbers of ink discharge times that is equal to or larger than the threshold value, and in which ink bleeding is less likely to occur.

In addition, as illustrated in FIG. 19A, in the image data before the edge region correction processing, the pixel values "11", "11", "11", and "01" are defined for the respective pixels corresponding to 4 pixel regions of the upper left, the upper right, the lower left, and the lower right pixel regions in the divided region 607 being an edge region. At a position adjacent to 1 pixel region of the lower left pixel region among the 4 pixel regions in the divided region 607, there is a divided region with a difference in the total value of the numbers of ink discharge times that is equal to or larger than the threshold value. Thus, in step S757, the processing of reducing a pixel value is executed on the pixel corresponding to the lower left pixel region in the divided region 607. On the other hand, at positions adjacent to the upper left, the upper right, and the lower right pixel regions in the divided region 607, there is no divided region with a difference in the total value of the numbers of ink discharge times that is equal to or larger than the threshold value. Thus, the processing of reducing pixel values is not executed on the pixels corresponding to the upper left, the upper right, and the lower right pixel regions in the divided region 607. As a result, in the correction data after the edge region correction processing that is illustrated in FIG. 19C, the pixel values "11", "11", "10", and "01" are defined for the respective pixels corresponding to 4 pixel regions of the upper left, the upper right, the lower left, and the lower right pixel regions in the divided region 607. Thus, while the total value of the numbers of ink discharge times for the divided region 607 has been 10 before the execution of the edge region correction processing, as illustrated in FIG. 19B, the total value can be reduced to 9 after the execution of the edge region correction processing, as illustrated in FIG. 19D. Furthermore, the edge region correction processing can be executed in such a manner that the number of ink discharge times is not reduced for the upper left, the upper right, and the lower right pixel regions in the divided region 607, which are not adjacent to a divided region with a difference in the total value of the numbers of ink discharge times that is equal to or larger than the threshold value, and in which ink bleeding is less likely to occur.

In addition, as illustrated in FIG. 19A, in the image data before the edge region correction processing, the pixel values "11", "10", "10", and "01" are defined for the respective pixels corresponding to 4 pixel regions of the upper left, the upper right, the lower left, and the lower right pixel regions in the divided region 611 being an edge region. At positions adjacent to the 3 pixel regions of the upper left, the lower left, and the lower right pixel regions among the 4 pixel regions in the divided region 611, there are divided regions with a difference in the total value of the numbers of ink discharge times that is equal to or larger than the threshold value. Thus, in the respective steps S753, S757, and S759, the processing of reducing pixel values is executed on the pixels corresponding to the upper left, the lower left, and the lower right pixel regions in the divided region 611. On the other hand, at a position adjacent to the upper right pixel region in the divided region 611, there is no divided region with a difference in the total value of the numbers of ink discharge times that is equal to or larger than the threshold value. Thus, the processing of reducing a pixel value is not executed on the pixel corresponding to the upper right pixel region in the divided region 611. As a result, in the correction data after the edge region correction processing that is illustrated in FIG. 19C, the pixel values "10", "10", "01", and "00" are defined for the respective pixels corresponding to 4 pixel regions of the upper left, the upper right, the lower left, and the lower right pixel regions in the divided region 611. Thus, while the total value of the numbers of ink discharge times for the divided region 611 has been 8 before the execution of the edge region correction processing, as illustrated in FIG. 19B, the total value can be reduced to 5 after the execution of the edge region correction processing, as illustrated in FIG. 19D. Furthermore, the edge region correction processing can be executed in such a manner that the number of ink discharge times is not reduced for the upper right pixel region in the divided region 611, which is not adjacent to a divided region with a difference in the total value of the numbers of ink discharge times that is equal to or larger than the threshold value, and in which ink bleeding is less likely to occur.

As described above, according to the present exemplary embodiment, in the case of processing image data including multiple-bit information, different correction processes can be executed on image data corresponding to divided regions being edge regions, depending on the position of a pixel region in a divided region.

Fifth Exemplary Embodiment

In the first to fourth exemplary embodiments, the description has been given of the configuration of performing recording by performing a plurality of times of scanning and recording operations on a unit region on a recording medium.

In contrast, in the present exemplary embodiment, the description will be given of the configuration of using a plurality of recording heads each having the length equivalent to the entire area in the width direction (Z direction) of a recording medium, and corresponding to the respective inks, and performing recording by performing the relative scanning and recording operations of the recording heads and the recording medium once.

In addition, the description of the parts similar to the above-described first to fourth exemplary embodiments will be omitted.

Figure 20:
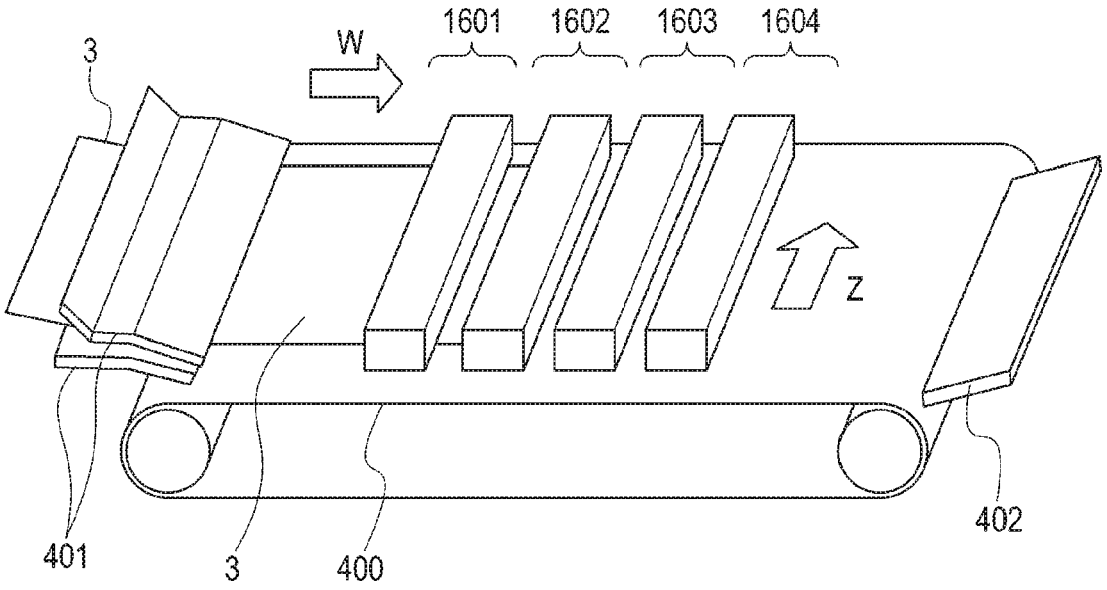
FIG. 20 is a perspective view of an image recording device to be applied in an exemplary embodiment.

FIG. 20 is a side view partially illustrating an internal configuration of an image recording device according to the present exemplary embodiment.

In each one recording head (discharge port array group) of four recording heads 1601 to 1604, a predetermined number of discharge ports (not illustrated) for discharging respective inks of yellow (Y), magenta (M), photo magenta (Pm), cyan (C), photo cyan (Pc), black (Bk), gray (Gy), photo gray (Pgy), red (R), blue (B), and processing liquid (P) are arrayed in the Z direction. Thus, a total of four discharge port arrays for discharging ink of one color are arrayed in the recording heads 1601 to 1604. The length in the Z direction of the discharge port array is set to be longer than the length in the Z direction of the recording medium 3 so that recording can be performed throughout the entire area in the Z direction on the recording medium 3. These recording heads 601 to 604 are arranged in the W direction intersecting with the Z direction. In addition, the four recording heads 1601 to 1604 are collectively referred to as a recording unit.

A conveyance belt 400 is a belt for conveying the recording medium 3. By rotating, the conveyance belt 400 conveys the recording medium 3 from a feeding unit 401 to a discharging unit 402 in the W direction intersecting with the Z direction.

In the image recording device, an image can be completed by performing scanning and recording operations once. Thus, recording time can be shortened.

In the present exemplary embodiment, the masking processing in step S606 is executed for the four discharge port arrays for discharging ink of the same color that are included in the recording heads 1601 to 1604 illustrated in FIG. 20, using a mask pattern corresponding to each scanning operation that is used in the first to fourth exemplary embodiments. For example, the mask pattern illustrated in FIG. 6C-1 is applied to a discharge port array for discharging ink of a predetermined color that is included in the recording head 1601, thereby distributing correction data. Similarly, the respective mask patterns illustrated in FIGS. 6C-2, 6C-3, and 6C-4 are applied to discharge port arrays for discharging ink of the predetermined color that are included in the respective recording heads 1602, 1603, and 1604, thereby distributing correction data.

Furthermore, in the present exemplary embodiment, the edge region correction processing described in the first to fourth exemplary embodiments is performed on image data corresponding to ink of a predetermined color that is obtained through color conversion processing or the like, thereby generating correction data. In this manner, in the present exemplary embodiment, the masking processing and the edge region correction processing are performed assuming that the four discharge port arrays correspond to four scanning operations. With this configuration, even in the case of using a plurality of recording heads, recording can be performed while suppressing the bleeding of ink of a predetermined color at an edge region when image data including multiple-bit information is used.

In addition, the length in the Z direction of the discharge port array used in the present exemplary embodiment is a length equivalent to the width of the recording medium. Alternatively, a so-called connected head, which has a long length by arranging a plurality of short discharge port arrays in the Z direction, can be used as a recording head.

In addition, in each of the above-described exemplary embodiments, the configuration of using the decode table illustrated in FIG. 7 has been described. Alternatively, another configuration may be used. For example, a decode table as illustrated in FIG. 21 may be used.

If the decode table illustrated in FIG. 21 is used, when a code value is "00", no ink is discharged even if a pixel value in a corresponding pixel is any of "00", "01", "10", and "11". In other words, a code value "00" in a mask pattern corresponds to no permission for ink discharge (the number of ink discharge permitted times being 0).

On the other hand, if the decode table illustrated in FIG. 21 is used, when a code value is "01", if a pixel value in a corresponding pixel is "00", no ink is discharged, but if a pixel value in a corresponding pixel is "01", "10", or "11", ink is discharged. In other words, a code value "01" corresponds to three ink discharge permissions among 4 patterns of pixel values ("00", "01", "10", and "11")(the number of ink discharge permitted times being 3).

In addition, when a code value is "10", if a pixel value in a corresponding pixel is "00", "01", or "10", no ink is discharged, but if a pixel value in a corresponding pixel is "11", ink is discharged. In other words, a code value "10" corresponds to one ink discharge permission among 4 patterns of pixel values (the number of ink discharge permitted times being 1).

Furthermore, when a code value is "11", if a pixel value in a corresponding pixel is "00" or "01", no ink is discharged, but if a pixel value in a corresponding pixel is "10" or "11", ink is discharged. In other words, a code value "11" corresponds to two ink discharge permissions among the 4 patterns of pixel values (the number of ink discharge permitted times being 2).

Even in the case of using such a decode table, by executing the edge region correction processing described in the first to fifth exemplary embodiments, recording can be performed while suppressing ink bleeding at an edge region.

In addition, the present invention is not limited to a thermal-jet type inkjet recording device. The present invention can be effectively applied to various image recording devices such as a so-called piezoelectric type inkjet recording device that discharges ink using a piezoelectric element, for example.

In addition, in each exemplary embodiment, an image recording method using an image recording device has been described. The present invention can also be applied to the configuration of preparing an image processing apparatus, an image processing method, or a program for generating data for performing the image recording method described in each exemplary embodiment, separately from an image recording device. In addition, it should be appreciated that the present invention can be broadly applied to the configuration in which the above-described program is provided at a part of an image recording device.

In addition, the "recording medium" is not limited to sheets used in a general recording device, and broadly includes ink acceptable media such as cloth, a plastic film, a metal plate, glass, ceramics, wood, and leather.

Furthermore, "ink" refers to liquid that can be used for the formation of images, designs, patterns, and the like, the processing of a recording medium, or the processing of ink (e.g., coagulation or insolubilization of colorant in ink applied to a recording medium), by being applied to a recording medium.

According to an image processing apparatus and an image processing method according to the present invention, in the case of processing image data with which ink can be discharged onto one pixel region a plurality of times, recording data with which correction processing of image data corresponding to a specific region such as an edge region can be suitably performed, and recording can be performed while suppressing image quality deterioration resulting from ink bleeding can be generated.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-082596, filed Apr. 14, 2015, which is hereby incorporated by reference herein in its entirety.

What is claimed is:

1. An image processing apparatus for generating recording data to be used in each of a plurality of times of relative scanning of a recording head including a discharge port array in which discharge ports for discharging ink are arrayed in a predetermined direction, with respect to a unit region on a recording medium, in a crossing direction intersecting with the predetermined direction, the recording data defining ink discharge or non-discharge for each of a plurality of pixel regions corresponding to a plurality of pixels in the unit region, the image processing apparatus comprising:

a first acquisition unit configured to acquire image data in which information about a number of ink discharge times from 0 to N (N≥2) for each of the plurality of pixel regions is defined for each pixel;

a second acquisition unit configured to acquire, for each of a plurality of divided regions being obtained by dividing the unit region in the predetermined direction and the crossing direction and each including a plurality of pixel regions, information about a total value of respective numbers of ink discharge times for the plurality of pixel regions in each of the divided regions based on the image data acquired by the first acquisition unit;

a third acquisition unit configured to acquire, based on pieces of information about the respective total values for a plurality of divided regions adjacent to a target divided region, among pieces of information about the respective total values for the plurality of divided regions that have been acquired by the second acquisition unit, information about a representative value of numbers of ink discharge times for the plurality of adjacent divided regions;

a first generation unit configured to generate, based on the information acquired by the second acquisition unit and the information acquired by the third acquisition unit, correction data in which information indicating the number of ink discharge times from 0 to N for each of the plurality of pixel regions is defined for each pixel; and a second generation unit configured to generate, based on the correction data generated by the first generation unit, the recording data to be used in each of the plurality of times of scanning, wherein, (i) in a case in which a difference between the total value for the target divided region that is indicated by the information acquired by the second acquisition unit, and the representative value for the plurality of adjacent divided regions that is indicated by the information acquired by the third acquisition unit is larger than a first threshold value, the first generation unit generates the correction data so that a total value of the numbers of ink discharge times for the target divided region that is indicated by the correction data becomes smaller than a total value of the numbers of ink discharge times for the target divided region that is indicated by the image data, and (ii) in a case in which the difference is smaller than the first threshold value, the first generation unit generates the correction data so that a total value of the numbers of ink discharge times for the target divided region that is indicated by the correction data becomes equal to a total value of the numbers of ink discharge times for the target divided region that is indicated by the image data.

2. The image processing apparatus according to claim 1, wherein, (i–1) in a case in which the difference is larger than the first threshold value and the total value for the target divided region that is indicated by the information acquired by the second acquisition unit is larger than the representative value for the plurality of adjacent divided regions that is indicated by the information acquired by the third acquisition unit, the first generation unit generates the correction data so that a total value of the numbers of ink discharge times for the target divided region that is indicated by the correction data becomes smaller than a total value of the numbers of ink discharge times for the target divided region that is indicated by the image data, and (i–2) in a case in which the difference is larger than the first threshold value, and the total value for the target divided region that is indicated by the information acquired by the second acquisition unit is smaller than the representative value for the plurality of adjacent divided regions that is indicated by the information acquired by the third acquisition unit, the first generation unit generates the correction data so that a total value of the numbers of ink discharge times for the target divided region that is indicated by the correction data becomes equal to a total value of the numbers of ink discharge times for the target divided region that is indicated by the image data.

3. The image processing apparatus according to claim 1, wherein, (i–1) in a case in which the difference is larger than the first threshold value, and the number of ink discharge times for a predetermined pixel region in the target divided region is larger than a second threshold value, the first generation unit generates the correction data so that the number of ink discharge times for the predetermined pixel region that is indicated by the correction data becomes smaller than the number of ink discharge times for the predetermined pixel region that is indicated by the image data, and (i–2) in a case in which the difference is larger than the first threshold value, and the number of ink discharge times for the predetermined pixel region is equal to or smaller than the second threshold value, the first generation unit generates the correction data so that the number of ink discharge times for the predetermined pixel region that is indicated by the correction data becomes equal to the number of ink discharge times for the predetermined pixel region that is indicated by the image data.

4. The image processing apparatus according to claim 3, wherein the second threshold value is 1.

5. The image processing apparatus according to claim 1, wherein the third acquisition unit acquires, among the pieces of information about the respective total values for the plurality of adjacent divided regions that have been acquired by the second acquisition unit, the information about a smallest total value, as information about the representative value for the plurality of adjacent divided regions.

6. The image processing apparatus according to claim 1, wherein the third acquisition unit acquires, among the pieces of information about the respective total values for the plurality of adjacent divided regions that have been acquired by the second acquisition unit, information about an average value of a predetermined number of total values smaller than other total values, as information about the representative value for the plurality of adjacent divided regions.

7. The image processing apparatus according to claim 1, wherein the second generation unit generates the recording data based on the correction data generated by the first generation unit, and a mask pattern in which information about the number of ink discharge permitted times from 0 to M (M≥2) for each of the plurality of pixel regions is defined for each pixel.

8. The image processing apparatus according to claim 7, wherein the mask pattern includes a plurality of mask patterns corresponding to the plurality of times of scanning.

9. The image processing apparatus according to claim 8, wherein, for M pixels among a plurality of pixels corresponding to a same position in the plurality of mask patterns, respective pieces of information about the numbers of permitted times different from one another among the numbers of permitted times from 1 to M are defined.

10. The image processing apparatus according to claim 9, wherein, for all of pixels other than the M pixels among the plurality of pixels corresponding to the same position in the plurality of mask patterns, information indicating that the number of permitted times is 0 is defined.

11. The image processing apparatus according to claim 8, wherein, in the plurality of mask patterns, information about a predetermined number of permitted times among the numbers of permitted times from 1 to M is defined for about a same number of pixels.

12. The image processing apparatus according to claim 7, wherein M=N.

13. The image processing apparatus according to claim 12, wherein M=N=3.

14. The image processing apparatus according to claim 7, wherein the second generation unit generates the recording data according to information about the number of discharge times for defining the correction data and information about the number of permitted times for defining the mask pattern, using a table that defines ink discharge or non-discharge for each pixel region.

15. The image processing apparatus according to claim 14, wherein, (i) in a case in which the number of discharge times indicated by the information for defining the image data is a first number of discharge times, and the number of permitted times indicated by the information for defining the mask pattern is a first number of permitted times, the table defines ink discharge, and (ii) in a case in which the number of discharge times indicated by the information for defining the image data is the first number of discharge times, and the number of permitted times indicated by the information for defining the mask pattern is a second number of permitted times being smaller than the first number of permitted times, the table defines ink non-discharge.

16. The image processing apparatus according to claim 15, wherein, in a case in which the number of discharge times indicated by the information for defining the image data is a second number of discharge times being smaller than the first number of discharge times, and the number of permitted times indicated by the information for defining the mask pattern is the first number of permitted times, the table defines ink non-discharge.

17. The image processing apparatus according to claim 7, wherein information about the number of discharge times for defining the image data is a-bit information (a≥2), and wherein information about the number of permitted times for defining the mask pattern is b-bit information (b≥2).

18. The image processing apparatus according to claim 1, further comprising the recording head.

19. An image processing method for generating recording data to be used in each of a plurality of times of relative scanning of a recording head including a discharge port array in which discharge ports for discharging ink are arrayed in a predetermined direction, with respect to a unit region on a recording medium, in a crossing direction intersecting with the predetermined direction, the recording data defining ink discharge or non-discharge for each of a plurality of pixel regions corresponding to a plurality of pixels in the unit region, the image processing method comprising:

a first acquisition step of acquiring image data in which information about a number of ink discharge times from 0 to N (N≥2) for each of the plurality of pixel regions is defined for each pixel;

a second acquisition step of acquiring, for each of a plurality of divided regions being obtained by dividing the unit region in the predetermined direction and the crossing direction and each including a plurality of pixel regions, information about a total value of respective numbers of ink discharge times for the plurality of pixel regions in each of the divided regions based on the image data acquired by the first acquisition step;

a third acquisition step of acquiring, based on pieces of information about the respective total values for a plurality of divided regions adjacent to a target divided region, among pieces of information about the respective total values for the plurality of divided regions that have been acquired by the second acquisition step, information about a representative value of numbers of ink discharge times for the plurality of adjacent divided regions;

a first generation step of generating, based on the information acquired by the second acquisition step and the information acquired by the third acquisition step, correction data in which information indicating the number of ink discharge times from 0 to N for each of the plurality of pixel regions is defined for each pixel; and a second generation step of generating, based on the correction data generated by the first generation step, the recording data to be used in each of the plurality of times of scanning, wherein, (i) in a case in which a difference between the total value for the target divided region that is indicated by the information acquired by the second acquisition step, and the representative value for the plurality of adjacent divided regions that is indicated by the information acquired by the third acquisition step is larger than a first threshold value, the first generation step generates the correction data so that a total value of the numbers of ink discharge times for the target divided region that is indicated by the correction data becomes smaller than a total value of the numbers of ink discharge times for the target divided region that is indicated by the image data, and (ii) in a case in which the difference is smaller than the first threshold value, the first generation step generates the correction data so that a total value of the numbers of ink discharge times for the target divided region that is indicated by the correction data becomes equal to a total value of the numbers of ink discharge times for the target divided region that is indicated by the image data.

* * * * *